US005903806A

United States Patent [19]

Matsuoka et al.

[11] Patent Number: 5,903,806

[45] Date of Patent: May 11, 1999

[54] DEVELOPING AGENT REPLENISHING APPARATUS AND CARTRIDGE

[75] Inventors: Isao Matsuoka; Yozo Fujii, both of Hachioji, Japan

[73] Assignee: Konica Corporation, Tokyo, Japan

[21] Appl. No.: 08/902,898

[22] Filed: Jul. 30, 1997

[30] Foreign Application Priority Data

| | | | |
|---|---|---|---|
| Aug. 7, 1996 | [JP] | Japan | 8-208287 |
| Aug. 21, 1996 | [JP] | Japan | 8-219810 |

[51] Int. Cl.[6] ..... G03G 15/08

[52] U.S. Cl. ..... 399/258; 399/262; 222/DIG. 1

[58] Field of Search ..... 399/258, 262, 399/263; 222/DIG. 1, 444, 449, 518, 633, 549, 559; 220/348, 350, 380

[56] References Cited

U.S. PATENT DOCUMENTS

| | | | |
|---|---|---|---|
| 3,446,403 | 5/1969 | Serio . | |
| 3,971,493 | 7/1976 | Williams . | |
| 4,271,986 | 6/1981 | Stecker | 222/151 |
| 4,719,949 | 1/1988 | Mears | 141/301 |
| 5,074,342 | 12/1991 | Kraehn . | |
| 5,154,212 | 10/1992 | Weber . | |
| 5,248,847 | 9/1993 | Aoyama | 399/238 |
| 5,481,344 | 1/1996 | Yasuda et al. | 399/120 |
| 5,495,323 | 2/1996 | Meetze, Jr. . | |
| 5,500,719 | 3/1996 | Ichikawa et al. | 399/238 |
| 5,557,382 | 9/1996 | Tatsumi et al. | 399/262 |
| 5,589,919 | 12/1996 | Ikunami et al. . | |
| 5,620,434 | 4/1997 | Brony | 604/406 |
| 5,765,079 | 6/1998 | Yoshiki et al. | 399/258 |

FOREIGN PATENT DOCUMENTS

| | | |
|---|---|---|
| 0604999 A2 | 7/1994 | European Pat. Off. . |
| 87 08 034 | 6/1987 | Germany . |
| 19541680 A1 | 5/1996 | Germany . |
| 3-87864 | 4/1991 | Japan . |
| 7-295356 | 11/1995 | Japan . |

*Primary Examiner*—Robert Beatty
*Attorney, Agent, or Firm*—Frishauf, Holtz, Goodman, Langer & Chick

[57] ABSTRACT

A developing agent replenishing apparatus includes a developing agent receiving port for receiving a developing agent from a replenishment cartridge which stores developing agent when the cartridge is mounted and a conveyor for conveying the developing agent received in the receiving port to a developing device. The developer agent receiving port has a receiving opening and the replenishment cartridge has a replenishment opening. Cylindrical expandable covers are provided at the receiving and replenishment openings for opening or closing these openings.

39 Claims, 19 Drawing Sheets

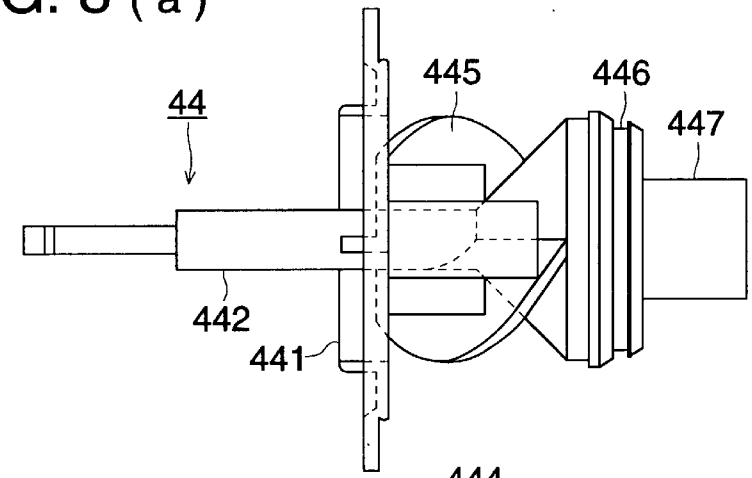
FIG. 8 ( a )
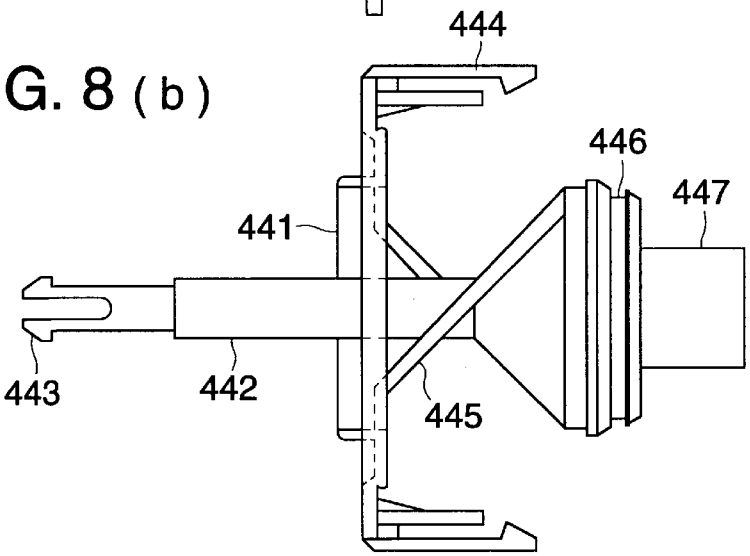
FIG. 8 ( b )
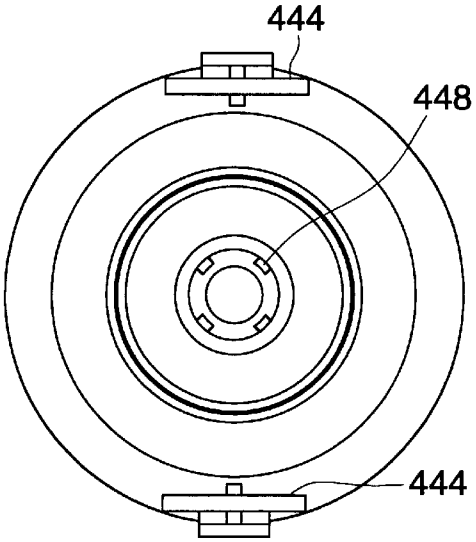
FIG. 8 ( c )

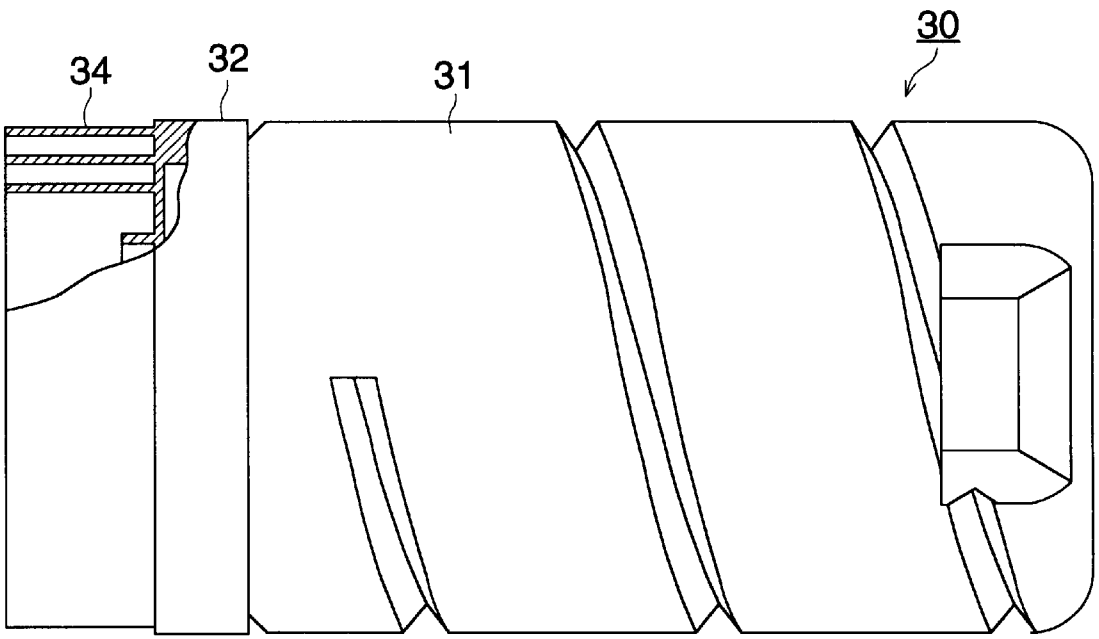
FIG. 16 ( b )
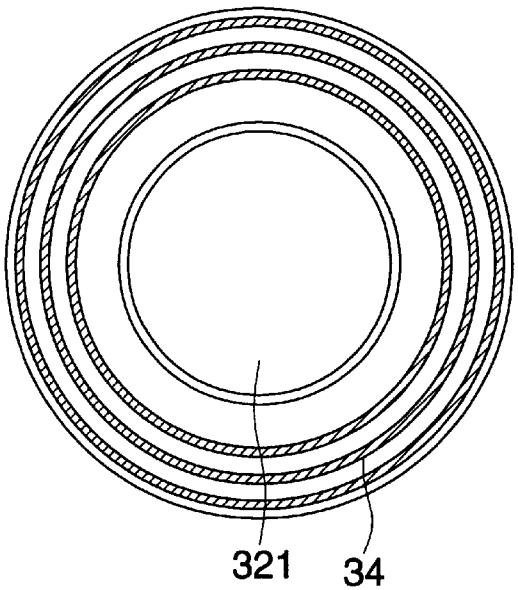
FIG. 16 ( a )

DEVELOPING AGENT REPLENISHING APPARATUS AND CARTRIDGE

BACKGROUND OF THE INVENTION

The present invention relates to a powder storing container containing powder, a developing agent cartridge which rotates to replenish a developing agent, a developing agent replenishing apparatus on which the developing agent cartridge is attached to supply a developing agent to a developing agent receiving port, and a color image forming apparatus loaded with a plurality of developing agent cartridges.

Heretofore, as a means to replenish a developing agent to a developing agent storing section of an image forming apparatus from a developing agent cartridge containing a developing agent, there has been known a device of a type wherein a developing agent cartridge is set in a main body when replenishing a developing agent, then developing agents in the developing agent cartridge are supplied to a developing agent receiving port, and after supplying is finished, the developing agent cartridge is removed from the main body. However, there has been a possibility in the replenishing method of the above-mentioned type that the developing agents are excessively supplied and overflow the developing agent receiving port because developing agents are supplied to the developing agent receiving port in a manner, which has required a means to prevent excessive replenishment of a developing agent. However, it is difficult to prevent excessive replenishment, and the conventional apparatus has been required to be high in cost and large in size, even if a means to prevent excessive replenishment can be installed on the apparatus. With the foregoing as a background, there has been developed a replenishing method of a type (Japanese Patent Application No. 088807/1994) published as Japanese Tokkai-Hei 7-295356 wherein a developing agent cartridge having therein a spiral-shaped protrusion is set in the apparatus main body, the developing agent cartridge is rotated around its central axis, developing agents are ejected from a developing agent outlet of the developing agent cartridge, and the developing agents are replenished to a developing agent receiving port. Since a developing agent cartridge is always loaded on the apparatus main body in the replenishing method of this type, it is possible to replenish developing agents to the developing agent receiving port by rotating the developing agent cartridge, when developing agents in the developing agent receiving port are reduced, which makes it unnecessary to prevent aforesaid excessive replenishment of a developing agent.

However, the developing agent cartridge and the developing agent replenishing apparatus which is loaded with the developing agent cartridge have the following problems.

(1) In the developing agent cartridge wherein it is mounted on or dismounted from a rotating force transmission member which transmits rotating force to the developing agent cartridge, while the developing agent cartridge is rotated, and an opening/closing cover provided at a developing agent replenishment opening is opened and closed respectively when the developing agent cartridge is mounted and dismounted, the opening is opened and closed when a cartridge fixing cover for the developing agent cartridge and a cartridge opening/closing cover are slid, but it is difficult that an entire circumferential surface of one cover comes in contact with that of the opponent cover. Therefore, there is a possibility that a developing agent exists in a clearance between both covers, which makes sealing of the opening/closing cover to be problematic.

(2) In the developing agent cartridge wherein it is mounted on or dismounted from a driving and rotating force transmission member by moving the developing agent cartridge horizontally, and an opening/closing cover of the developing agent cartridge or the like is opened and closed respectively when the developing agent cartridge is mounted and dismounted, when the outlet of the developing agent cartridge is closed, a recessed portion of the developing agent cartridge is engaged with a protrusion of the cartridge opening/closing cover. Under this structure, a part of the protrusion touches a circumferential surface of the developing agent cartridge when the opening/closing cover opens or closes, and therefore, considerable amount of force is required for opening/closing operations.

(3) Some of developing agent replenishing apparatuses are represented by one wherein an opening/closing cover which opens or closes a developing agent outlet is provided on a developing agent cartridge, and the opening/closing cover opens or closes when the developing agent cartridge is loaded on or unloaded from the apparatus, with the opening/closing cover and a developing agent cartridge loading section both being in contact with each other. However, if the position of this contact is not appropriate, the opening/closing cover can not be opened or closed smoothly in the course of an operation to load or unload the developing agent cartridge, resulting in the problem that an action to replenish to the apparatus main body can not be conducted, or developing agents overflow when the developing agent cartridge is removed.

(4) In a plurality of detachable cartridges which can be loaded on and unloaded from the developing agent replenishing apparatus provided on a color image forming apparatus, it is necessary to prevent a disadvantage that developing agent cartridges containing developing agents used for different apparatuses or developing agent cartridges containing developing agents of different colors are loaded, resulting in existence of different developing agents in the developing agent replenishing apparatus.

Further, in some of developing agent cartridges for replenishing developing agents by rotating, there is provided an opening/closing cover which opens and closes a developing agent outlet of the developing agent cartridge.

In such a cartridge, the opening/closing cover is required to be closed to cover the developing agent outlet so that developing agents remaining in the cartridge do not overflow when the cartridge is dismounted from an image forming apparatus.

However, it has also been a problem that poor sealing of the opening/closing cover caused developing agents to overflow and soil user's hands despite the closed opening/closing cover when the cartridge was removed.

Therefore, it has been necessary to design the structure of the cartridge by taking the sealing characteristics of the opening/closing cover into consideration.

With regard to the cartridge mentioned above, there has been a possibility that the opening/closing cover is accidentally opened during transportation to cause developing agents to overflow.

Accordingly, it has also been necessary to design the structure of a cap member to be attached to the cartridge so that the opening/closing cover is not accidentally opened during transportation.

SUMMARY OF THE INVENTION

An object of the invention is to solve the aforesaid problems in a developing agent cartridge or in a developing agent replenishing apparatus which supplies developing agents from the developing agent cartridge to a developing means.

The object mentioned above can be attained by a developing agent replenishing apparatus having the following structure:

a developing agent receiving port which is a cylindrical expandable covering member and receives developing agents from a cartridge when the cartridge containing developing agents is attached; and a conveyor for conveying developing agents from the developing agent receiving port to a developing unit.

Or the above-mentioned object can be attained by a developing agent cartridge having the following structure:

a replenishment opening in which a cylindrical expandable covering member is arranged.

BRIEF DESCRIPTION OF THE DRAWINGS

FIGS. 8(*a*), 8(*b*) and 8(*c*) respectively represent a top view, a front view and a side view of the rotation power transmission member.

FIGS. 16(*a*) and 16(*b*) respectively represent a front view of the aforesaid cartridge and a side view thereof.

DETAILED DESCRIPTION OF THE PREFERRED EMBODIMENT

Prior to explanation of examples of the invention, the structure of a color printer which is an example of a color image forming apparatus equipped with a plurality of developing units of the invention and its operations will be explained as follows, referring to a sectional structure view in FIG. 1.

This color printer is a color image forming apparatus of a type for superposing toner images each having a different color formed on an image forming body in succession, then forming a color image by transferring collectively the toner images onto a recording sheet at a transfer section, and then separating the color image from the image forming body by a separating means.

Figure 1:
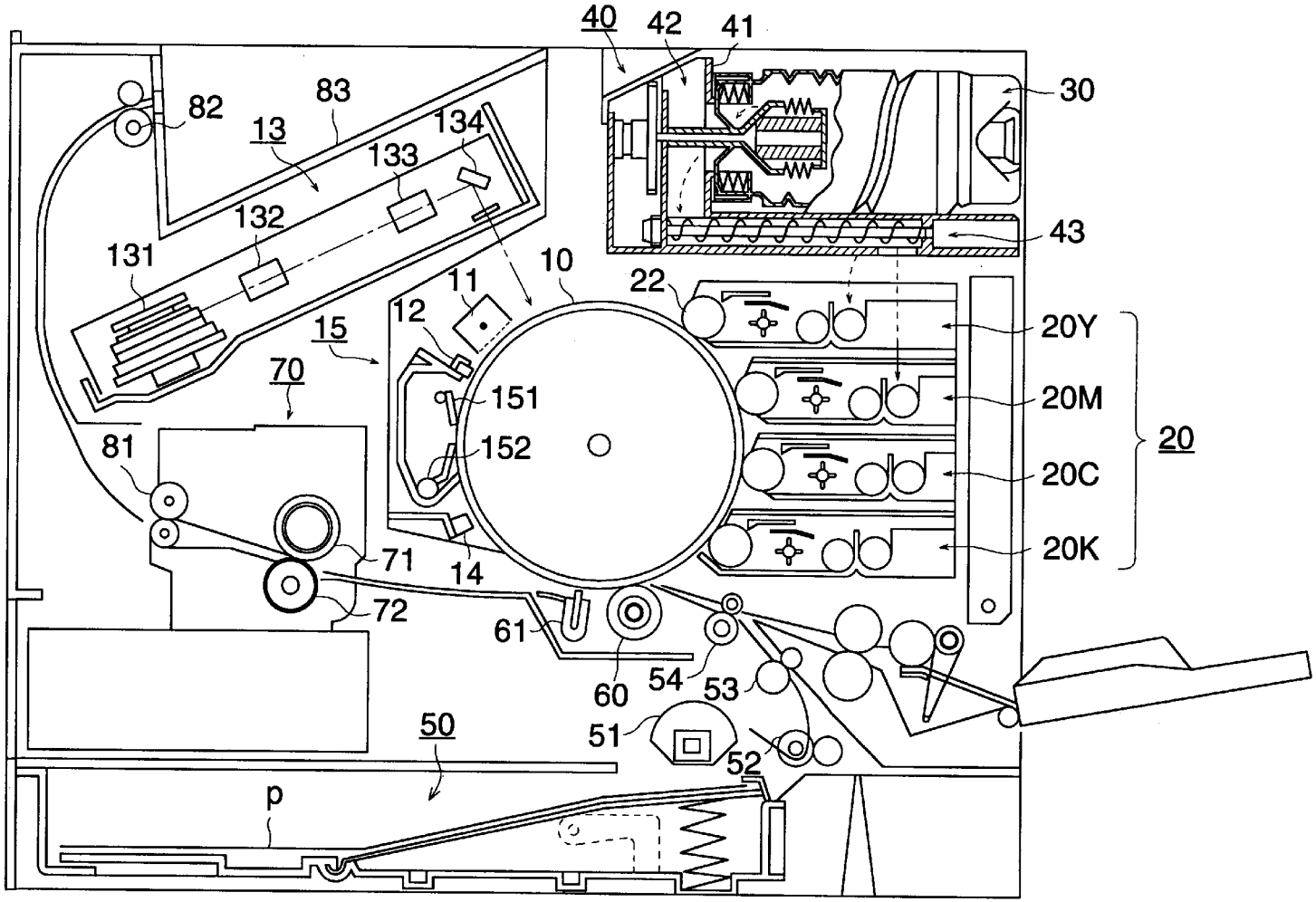
FIG. 1 sectional structure view of a color printer that is an example of a color image forming apparatus equipped with a plurality f developing units of the invention.

In FIG. 1, the numeral 10 is a photoreceptor drum representing an image forming body wherein OPC photoreceptor (organic photoreceptor) is coated on a drum base body to be formed thereon, and it is grounded and driven to be rotated clockwise in the drawing. The numeral 11 is a scorotron charger which gives uniform charging of high voltage VH to the circumferential surface of photoreceptor drum 10 through corona discharge by means of a grid kept to grid voltage VG and a corona discharge wire. Prior to charging by means of this scorotron charger 11, the circumferential surface of the photoreceptor is neutralized through exposure by means of PCL (pre-charging neutralizer) 12 employing a light-emitting diode, for eliminating hysteresis accumulated on the photoreceptor during a period up to the preceding print.

After uniform charging on photoreceptor drum 10, imagewise exposure based on image signals is carried out by imagewise exposure means 13. In the imagewise exposure means 13, a beam emitted from an unillustrated light source of laser diode passes through rotary polygon mirror 131, fθ lens 132 and cylindrical lens 133, and its optical path is deflected by reflecting mirror 134 for primary scanning which forms a latent image together with rotation (subscanning) of the photoreceptor drum 10. In the present example, exposure is conducted for the image portion to form a reversal latent image in which an image portion is at low voltage of VL.

Surrounding a portion of the circumferential surface of the photoreceptor drum 10, there is provided developing device 20 composed of developing units 20Y, 20M, 20C and 20K containing respectively 2-component developing agents each being composed of carrier and toner such as yellow (Y), magenta (M), cyan (C) or black (K) toner. First, development for the first color of yellow is conducted by developing agent carrier (developing sleeve) which houses magnets and rotates while holding therein developing agents. The developing agent is composed of a carrier having therein a core of ferrite coated on its surface with insulating resin and of toner whose primary material is polyester to which a pigment depending on toner color, a charge controlling agent, silica and titanium oxide are added. The developing agents are regulated by a layer forming means to be of a layer thickness (developing agents) of 100–600 $\mu$m on developing sleeve 22, to be conveyed to the developing area.

A clearance between the developing sleeve 22 and photoreceptor drum 10 in the developing area is 0.2–1.0 mm which is greater than a developing agent layer thickness, and AC bias of $V_{AC}$ and DC bias of $V_{DC}$ are superimposed and impressed into the aforesaid clearance. Since $V_{DC}$, $V_H$ and toner charging are of the same polarity, the toner urged by $V_{AC}$ to leave carrier does not stick to the portion where voltage is $V_H$ that is higher than $V_{DC}$ but sticks to the portion of $V_L$ that is lower than $V_{DC}$ so that image visualization (reversal development) is carried out.

After completion of visualization for the first color, a sequence enters an image forming process for the second color of magenta, and uniform charging is conducted by scorotron charger 11 again, and a latent image based on image data for the second color is formed by imagewise exposure means 13. In this case, neutralizing conducted by PCL 12 in the image forming process for the first color is not conducted, because toner stuck to the image portion for the first color may scatter due to sharp drop of surrounding voltage.

In the photoreceptor where entire surface of the circumferential surface of photoreceptor drum 10 is of voltage of $V_H$, for the portion having no image for the first color, there is formed a latent image identical to that for the first color to be developed, but for the portion which has an image for the first color and is to be developed again, a latent image of $V_M'$ is formed by light-shielding of the adhering toner for the first color and by charge owned by toner itself, thus development depending on the voltage difference between $V_{DC}$ and $V_M'$ is conducted. In the portion where the image for the first color and that for the second color are superposed, when the development for the first color is conducted after making a latent image of $V_L$, a balance between the first color and the second color is lost. Therefore, medium voltage satisfying the condition of $V_H>V_M>V_L$ is sometimes used by reducing an amount of exposure for the first color.

For the third color of cyan and the fourth color of black, an image forming process identical to that for the second color of magenta is also conducted, and four visual images each having a different color are formed on the circumferential surface of photoreceptor drum 10 accordingly.

The developing agent replenishing apparatus which refreshes fresh developing agent of each color by controlling it to each of the aforesaid developing units 20Y, 20M, 20C and 20K is composed of cartridge attaching section 41 which enables a plurality of developing agent cartridges (hereinafter referred to as cartridges) 30 (Y, M, C and K) to be attached or detached, developing agent receiving ports 42 (Y, M, C and K) which temporarily receive developing agents contained in cartridges 30, and developing agent conveyor 43 (Y, M, C and K) which convey developing agents in the developing agent receiving poets 42 to the developing units 20.

On the other hand, a sheet of transfer material (transfer sheet or the like) p fed out of paper cassette 50 through woodruff roller 51 passes through a pair of paper feed rollers 52 and 53, then temporarily stops at the point close to a pair of registration rollers 54, and is conveyed, when the timing for transfer is synchronized, to a transfer section by the rotation of the paired registration rollers 54.

In the transfer section, transfer means 60 is brought into pressure contact with the circumferential surface of photoreceptor drum 10 in synchronization with the transfer timing, and whereby, multi-color images are collectively transferred onto the transfer material p which is conveyed and sandwiched in the transfer means.

Then, the transfer material p is neutralized by separating means 61, then is separated from the circumferential surface of photoreceptor drum 10 and is conveyed to fixing unit 70 where toner is fixed by heat and pressure given respectively by heat roller (upper roller) 71 and pressure roller (lower roller) 72. After that, the transfer material p passes through ejection rollers 81 and 82 and is ejected on copy tray 83 located on the outside of an apparatus. Incidentally, the transfer means 60 leaves, after the transfer material p has passed through it, the circumferential surface of photoreceptor drum 10 to be away of it to be ready for the following formation of toner images.

On the other hand, the photoreceptor drum 10 from which the transfer material p has been separated is neutralized by neutralizing unit 14, then is cleaned by blade 151 of cleaning unit 15 that is in pressure contact with the photoreceptor drum to be free from residual toner thereon, and is subjected again to neutralizing by means of the PCL 12 and charging by means of scorotron charger 11 to enter the succeeding image forming process. Incidentally, the blade 151 moves to be away of the circumferential surface of photoreceptor drum 10 immediately after cleaning the photoreceptor surface. Waste toner scraped off by the blade 151 into the cleaning unit 15 is ejected by screw 152, and then is accumulated in an unillustrated container for collected waste toner.

Figure 2:
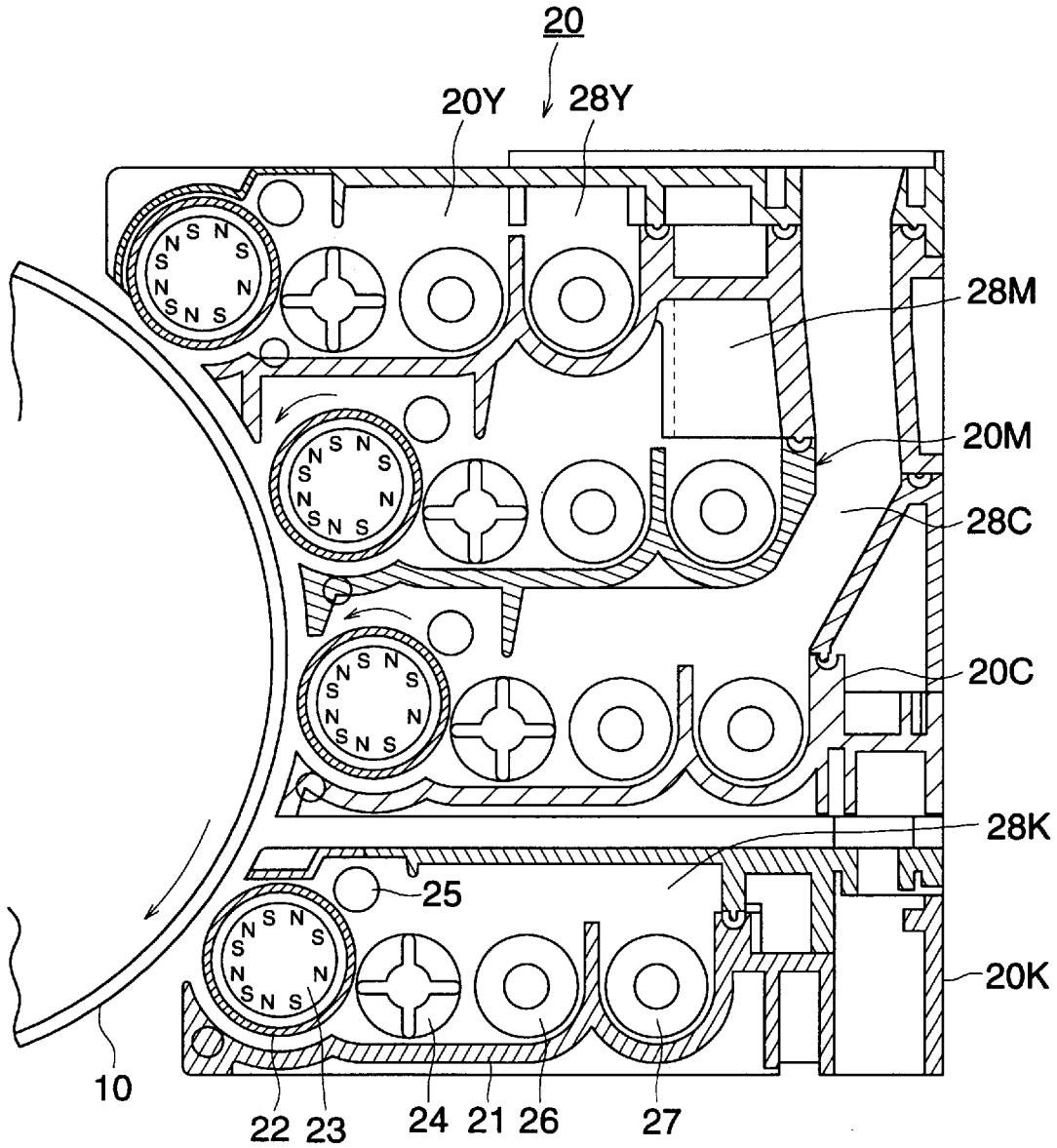
FIG. 2 is a sectional view showing the structure of the developing apparatus equipped with a plurality of developing units.

FIG. 2 is a sectional view showing the structure of developing device 20 equipped with a plurality of developing units. Surrounding a portion of the circumferential surface of the photoreceptor drum 10, there is provided developing device 20 composed of developing units 20Y, 20M, 20C and 20K containing respectively developing agents each being composed of carrier and toner such as yellow (Y), magenta (M), cyan (C) or black (K) toner. In the upper space of the developing units 20Y, 20M, 20C and 20K, there are provided developing agent replenishment openings 28Y, 28M, 28C and 28K which are communicated with the developing agent conveyor 43 (Y, M, C and K).

Since the developing units 20Y, 20M, 20C and 20K are mostly the same in terms of structure, the developing device 20 representing these developing units will be explained as follows.

In FIG. 2, the numeral 21 represents a developing unit casing containing 2-component developing agent composed of toner and carrier, 22 represents a developing agent carrier (hereinafter referred to as a developing sleeve) which is a developing agent conveying meats equipped with magnetic field generating means (magnet roll) 23 having therein a fixed magnet body, 24 represents a developing agent supplying roller (hereinafter referred to also as a supply paddle), 25 represents a developing agent layer thickness regulating member (hereinafter referred to as a layer thickness regulating bar) which regulates the thickness of a developer layer on the developing sleeve 22 to a prescribed value, 26 and 27 represent a developing agent stirring screw (hereinafter referred to as a stirring screw), and 28 (Y, M, C and K) represents a developing agent replenishment opening formed on the upper part of the developing unit casing 21, and it receives developing agents replenished from the cartridge 30 shown in FIG. 1 through developing agent receiving port 42 and developing agent conveyor 43.

Figure 3:
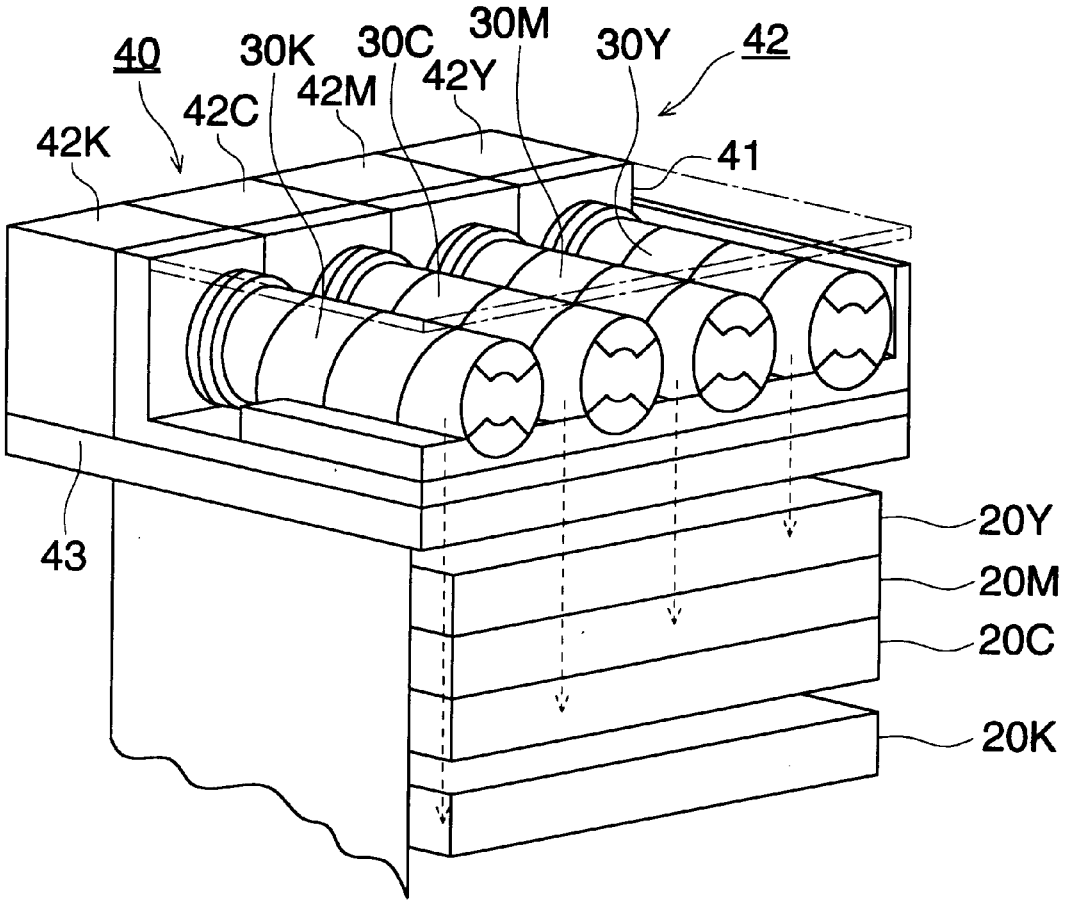
FIG. 3 is perspective view showing a cartridge, a developing agent receiving port and a part of a developing unit.

FIG. 3 is a perspective view showing cartridges 30Y, 30M, 30C and 30K, developing agent receiving ports 42Y, 42M, 42C and 42K, and a part of developing units 20Y, 20M, 20C and 20K. Cartridge attaching section 41 makes four cartridges 30Y, 30M, 30C and 30K to be set, on a detachable basis, in parallel with each other on the mostly same plane. It is arranged so that each developing agent in each of the cartridges 30Y, 30M, 30C and 30K may be controlled and replenished when an amount of toner in each of the aforesaid developing units 20Y, 2DM, 20C and 20K is reduced. Since the cartridges 30Y, 30M, 30C and 30K are mostly the same in terms of structure, the cartridge 30 representing these cartridges 30 (Y, M, C and K) will be explained as follows.

Figure 4:
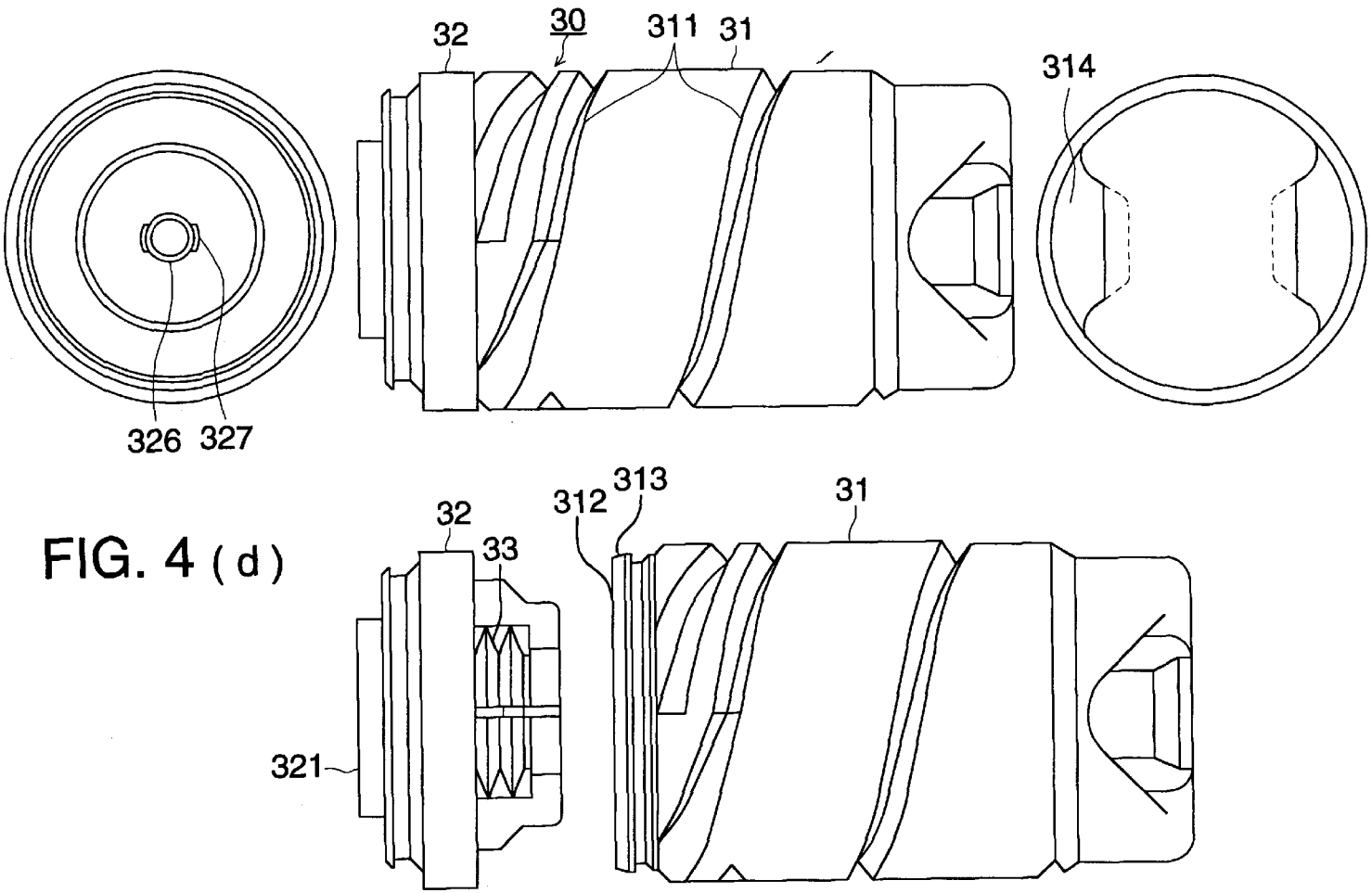
FIGS. 4(*a*), 4(*b*), 4(*c*) and 4(*d*) respectively represent a top view, a left side view, a right side view and an exploded top view, all of the cartridge.
Figure 5:
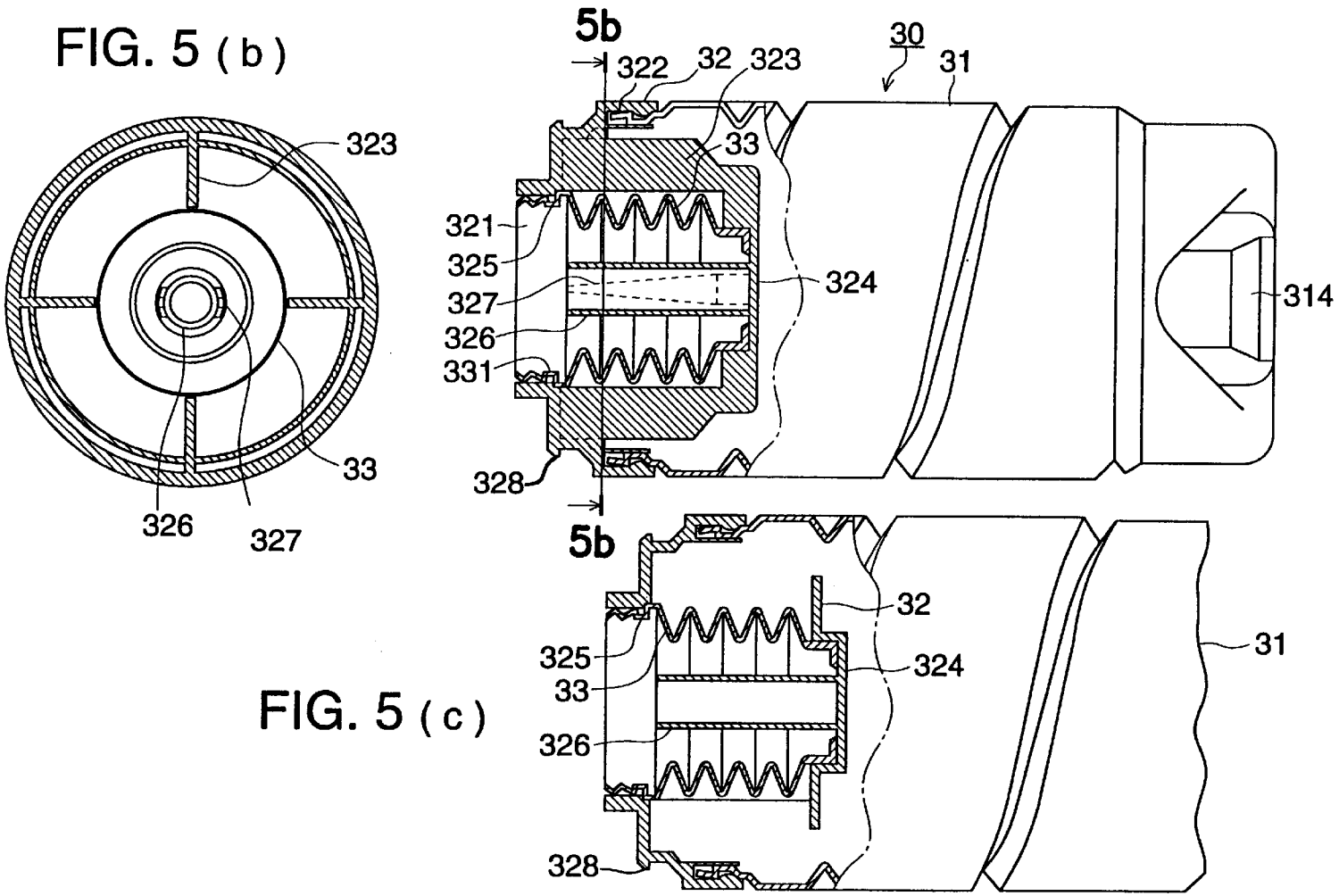
FIGS. 5(*a*), 5(*b*) and 5(*c*) respectively represent a partial section of a cartridge, a sectional view of a fixed cover taken on line 5*b*—5*b*, and another section of the cartridge.

FIGS. 4(*a*)–4(*d*) and FIGS. 5(*a*)–5(*c*) represent cartridge 30, wherein FIG. 4(*a*) is a top view of the cartridge 30, FIG. 4(*b*) represents a left side view, FIG. 4 (*c*) is a right side view, FIG. 4(*d*) is an exploded top view, FIG. 5(*a*) is a partial section of the cartridge 30, FIG. 5 (*b*) is a sectional view taken on line 5*b*—5*b* of fixed cover 32 of the cartridge 30, and FIG. 5(*c*) is another sectional view of the cartridge 30.

The cartridge 30 is composed of container main body 31 which is a cylinder whose inner surface is provided with guide portion (developing agent leading portion) 311 composed of a spiral protruded groove and contains developing agents, fixed cover 32 which is fixed solidly with opening 312 of the container main body 31 and has opening (replenishment opening) 321, and cartridge opening/closing cover 33 which is engaged inside the fixed cover 32 and takes a form of expandable bellows. Engagement claw portion 313 provided on the surrounding of the opening 312 of the container main body 31 is engaged closely with recessed portion 322 provided on the inner surrounding of the fixed cover 32 to be nipped and united solidly with the recessed portion. Grip portion 314 makes an operation to position cartridge 30 easy when attaching the cartridge 30 on the cartridge attaching section 41.

On the inner surface of the opening 321 of the aforesaid fixed cover 32, there is solidly formed 4-blade-shaped developing agent agitating portion (paddle) 323. Further, there is interposed cartridge opening/closing cover 33 between bottom portion 324 in the inner part of the fixed cover 32 and a projected portion protruded on the inner surface of the opening 321. The cartridge opening/closing cover 33 is one made to be bellow-shaped through blow molding, and it is fixed (welded) on the bottom portion 324 through ultrasonic welding. This fixing can also be done with adhesives. On the central portion of the bottom portion 324, there is projected hollow and cylindrical positioning portion 326. At two locations on the tip portion of the positioning portion 326, there is formed engagement projection 327 which regulates the position in the rotating direction of the cartridge 30. The numeral 328 is an engagement portion which engages, on a detachable basis, with cartridge coming-off preventing portion 444 of rotary power transmitting member 44 which will be explained later.

Figure 6:
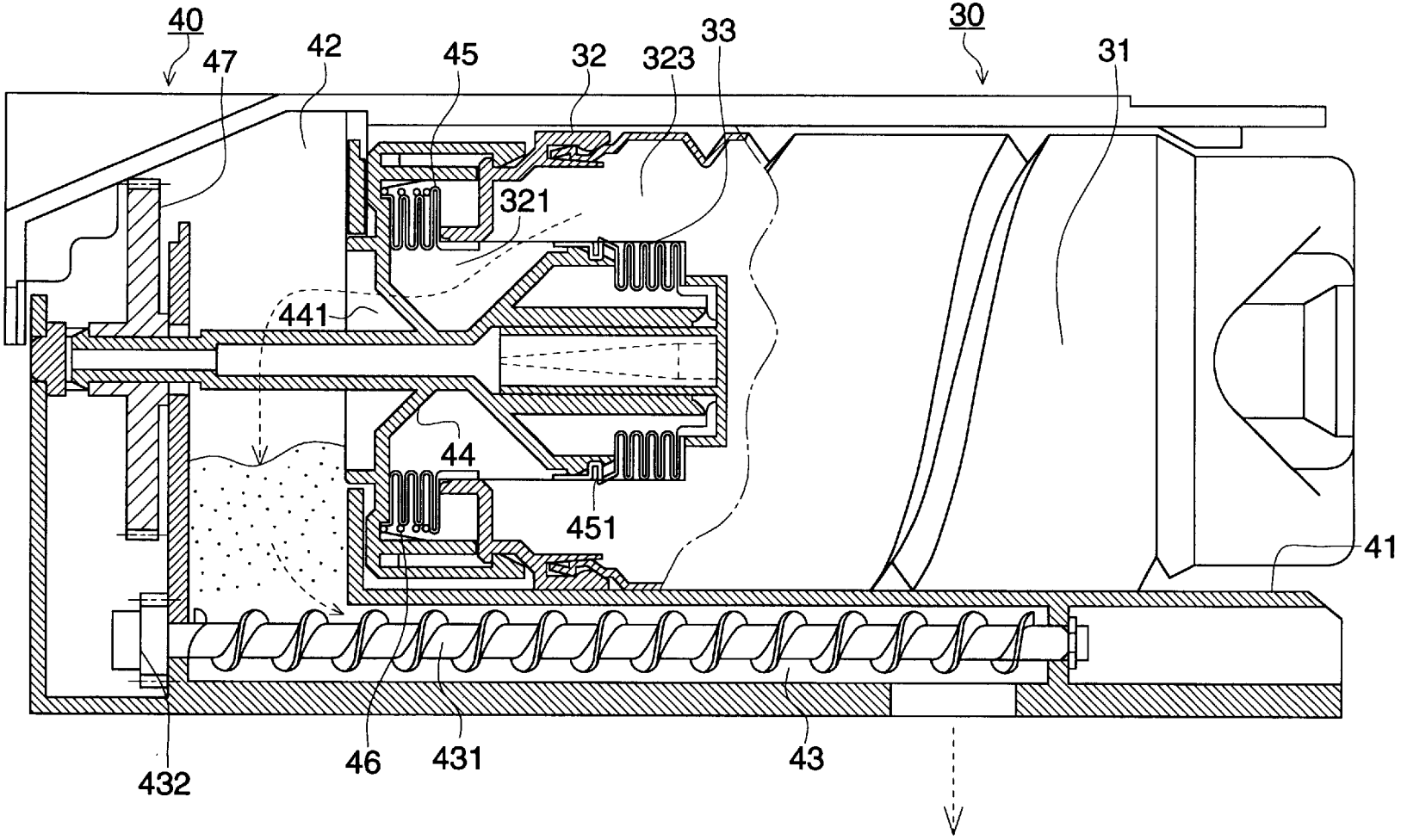
FIG. 6 represents a sectional view of a developing agent receiving port that is under the state where a cartridge is attached on a cartridge attachment section and a sectional view of a developing agent conveying section.
Figure 7:
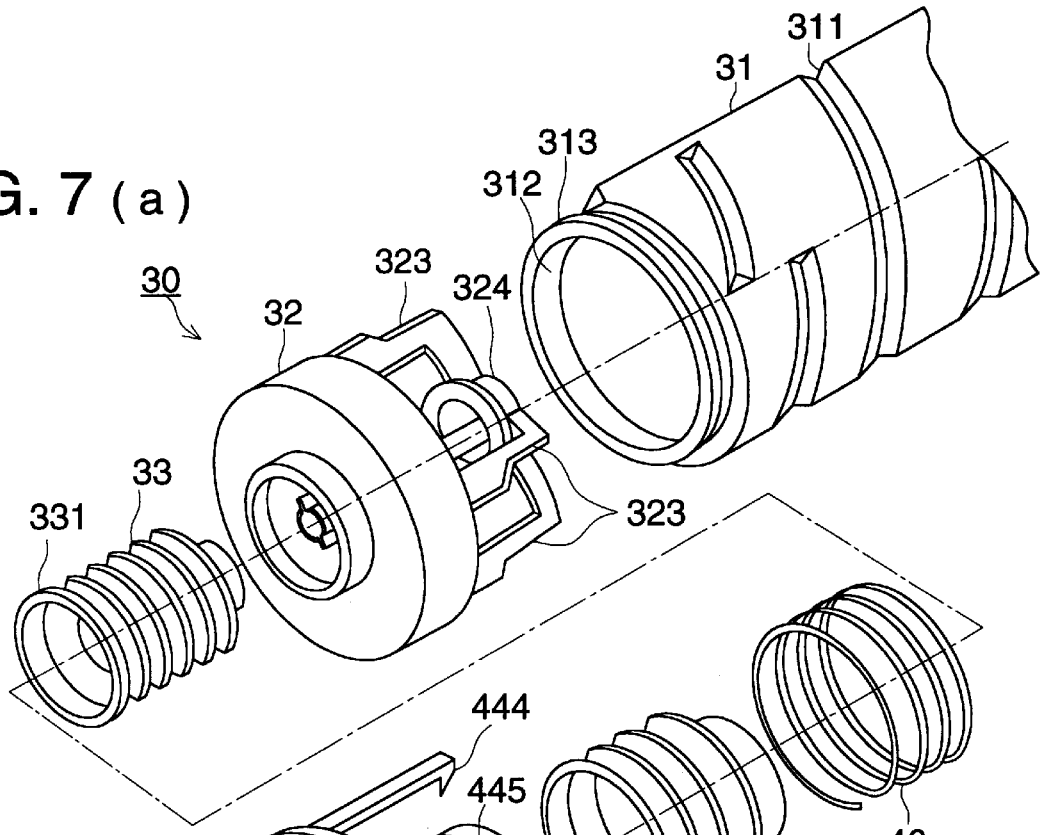
FIGS. 7(*a*) and 7(*b*) respectively represent an exploded sectional view of a cartridge and an exploded sectional view of a rotation power transmission member to be connected to the cartridge.
Figure 7:
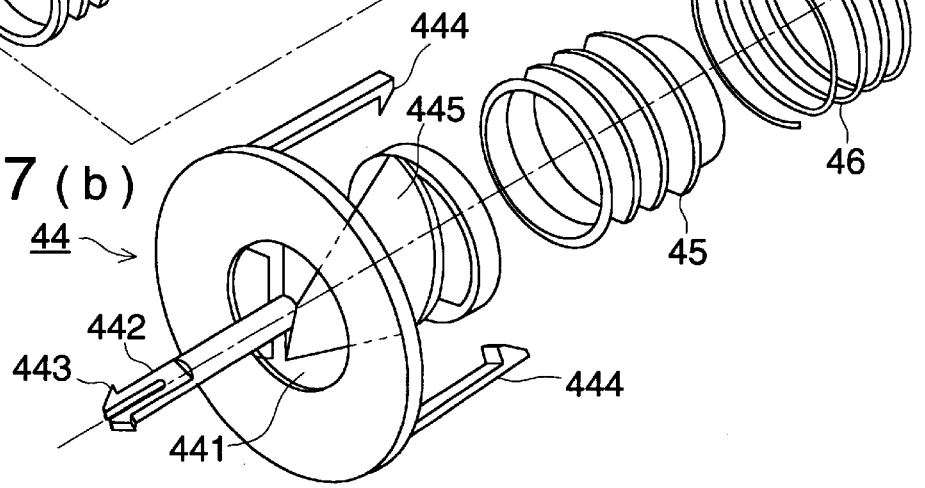

FIG. 6 is a sectional view showing the developing agent receiving port 42 under the state where the cartridge 30 is attached to the cartridge attaching section 41, and showing the developing agent conveying means 43. FIG. 7(*a*) is an exploded perspective view of the cartridge 30, and FIG. 7(*b*) is an exploded perspective view of the rotary power transmitting member 44 which is connected to the cartridge 30.

On the vertical wall side facing the opening 321 of cartridge 30 attached to the developing agent receiving port 42, there is rotatably supported rotary power transmitting member 44. On the position which is inside the power transmitting member 44 and faces the opening 321 of the cartridge 30, there are installed developing agent replenishing apparatus opening/closing cover 45 and coil spring 46. On one axial end of the rotary power transmitting member 44, there is fixed cartridge-turning gear 47 which is driven to rotate by an unillustrated driving source. When opening/closing cover 33 is opened by the-rotary power transmitting member 44, developing agents contained in container main body 31 of the cartridge 30 pass through replenishment opening section 441 of the rotary power transmitting member 44 from the opening 321, and then is contained in a hopper of the developing agent receiving port 42.

The cartridge 30 is rotated by the rotary power transmitting member 44, and thereby developing agents are replenished to the developing agent receiving port 42. However, after receiving a certain amount of them, developing agents are not replenished even when the cartridge 30 is rotated. Even if the cartridge 30 continues rotating under such condition, no problem will happen.

The developing agents contained in the hopper of the developing agent receiving port 42 are fed into conveyance screw 431 fixed on gear for conveyance screw 432, then are conveyed through the inside of developing agent conveyor 43, and are replenished to the developing unit 20.

FIGS. 8(*a*)–8(*c*) show the rotary power transmitting member 44 mentioned above, in which FIG. 8(*a*) is a top view, FIG. 8(*b*) is a front view, and FIG. 8(*c*) is a side view.

In FIGS. 8(*a*) and 8(*b*), rotary shaft portion 442 projected to the left in the drawing is connected with the cartridge-turning gear 47 through engagement claw portion 443 on the axial end portion, to be driven to rotate solidly with the gear 47. At two locations on the rotary power transmitting member 44 cartridge coming-off preventing portion 444 is provided to be projected so that it may be engaged on a detachable basis with engagement portion 328 of the fixed cover 32. In the vicinity of the central portion of the rotary power transmitting member 44, there is formed developing agent guide portion 445 which conveys developing agents to the developing agent receiving port 42. In the vicinity of the outer circumferential portion of the developing agent guide portion 445, there is provided ring-shaped recessed portion 446 which is engaged on a detachable basis with engagement portion 331 of the cartridge opening/closing cover 33. Further, inside hollow cylindrical portion 447 near the right end of the rotary power transmitting member 44 in the drawing, there are provided four stripes of engagement projection 448 which engage on a detachable basis with engagement projection 327 of the fixed cover 32 shown in FIGS. 5(*a*)–5(*c*). Due to this, positioning for attaching the cartridge 30 and transmitting of rotary power from the rotary power transmitting member 44 are made to be possible.

Figure 9:
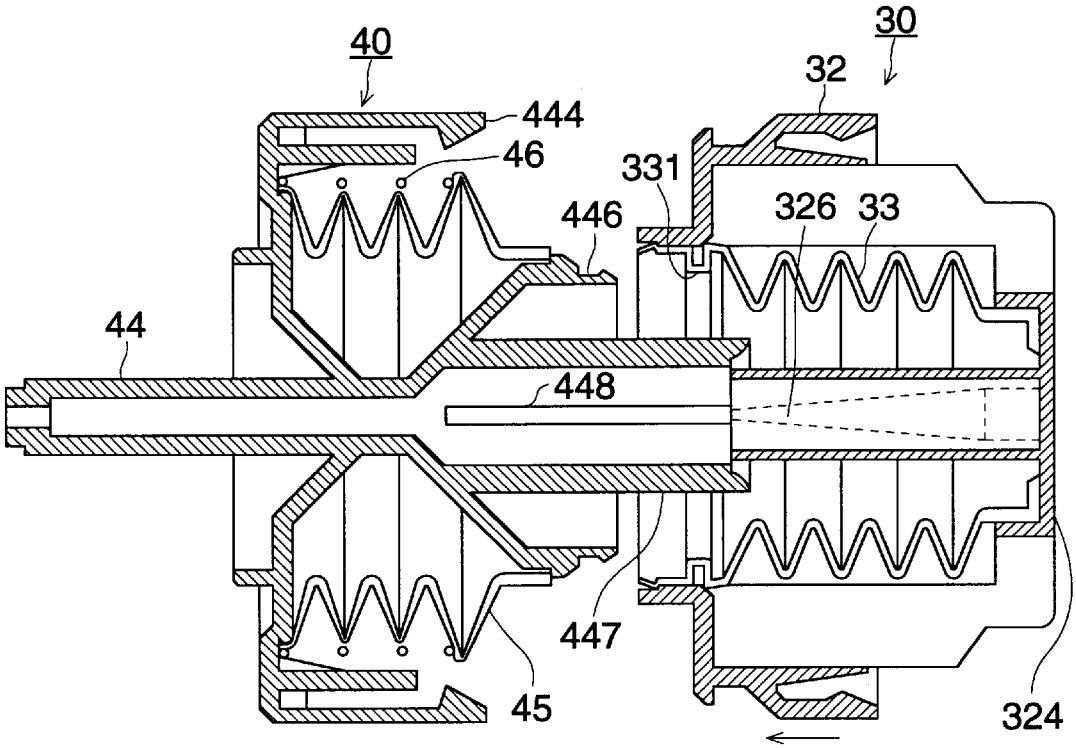
FIGS. 9(*a*) and 9(*b*) respectively represent a sectional view of the state right before the attachment of a cartridge on a developing agent replenishing apparatus and a sectional view of the state of the start of the attachment.
Figure 9:
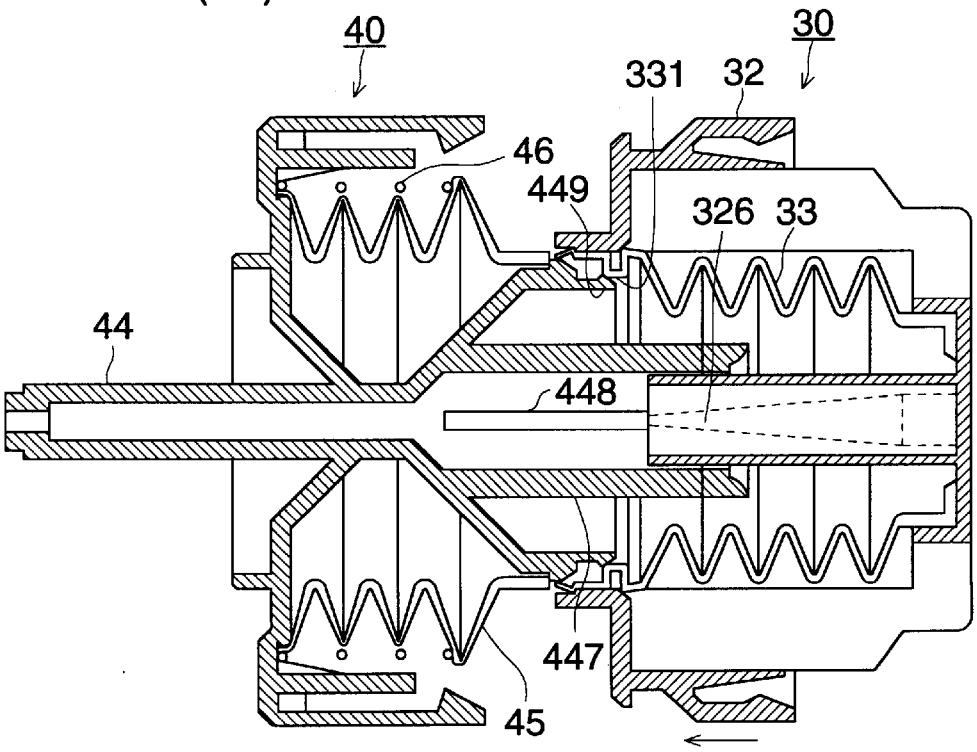
Figure 11:
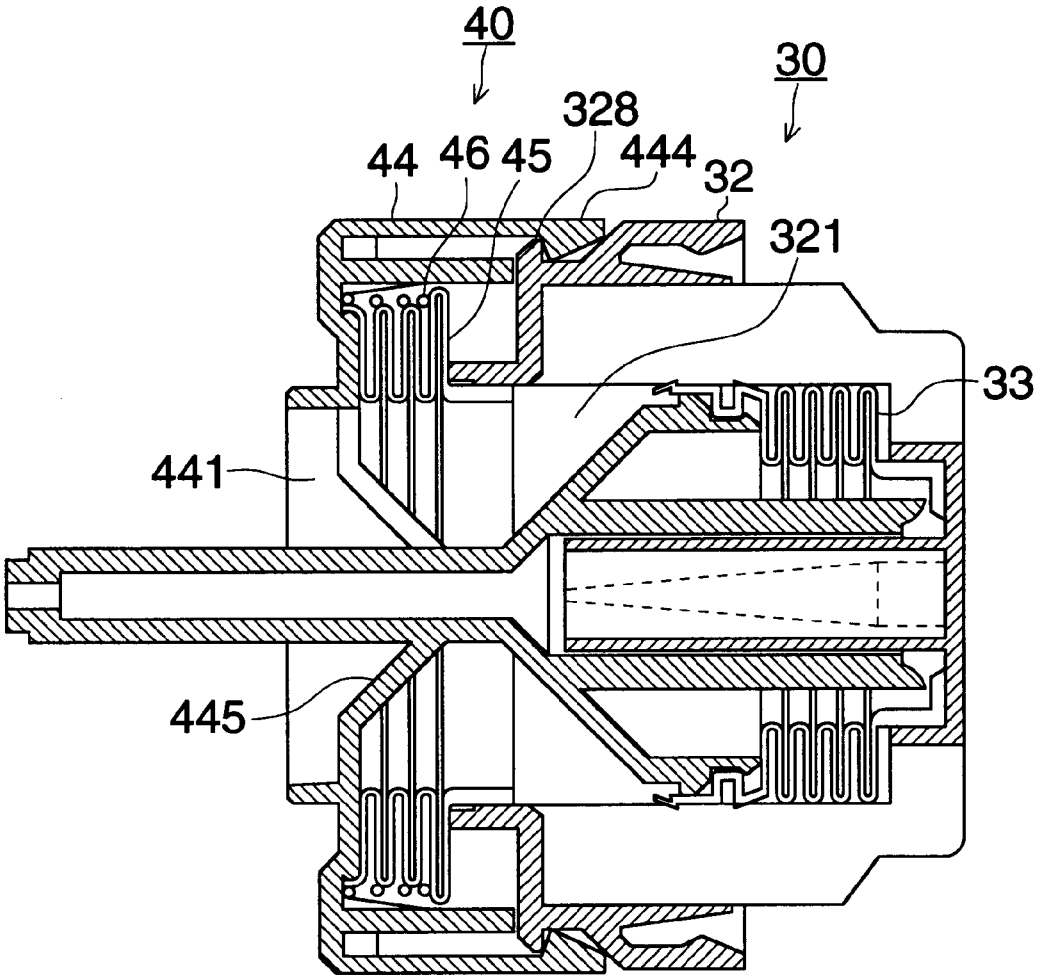
FIG. 11 is a sectional view showing that a cartridge has just been attached on a developing agent replenishing apparatus.

FIG. 9(*a*)–FIG. 11 represent sectional views each showing the process for attaching the cartridge 30 to developing agent replenishing apparatus 40. It is arranged so that the cartridge 30 can be attached to or detached from the developing agent replenishing apparatus 40 in the direction. being in parallel with its axis of rotation.

FIG. 9(*a*) shows the state wherein the cartridge 30 is about to be attached on the developing agent replenishing apparatus 40. In this state to start attaching, the developing agent replenishing apparatus opening/closing cover 45 is in its expanded state due to the anti-contraction returning force of the bellows portion of the developing agent replenishing apparatus opening/closing cover 45 and to the urging force of the coil spring 46, and the cartridge opening/closing cover 33 is kept in its expanded state by the anti-contraction returning force of the bellows portion.

FIG. 9(*b*) represents the state wherein the cartridge 30 has been advanced straight in the arrowed direction, and is about to be attached on the developing agent replenishing apparatus 40. In this state to start attaching, positioning portion 326 provided inside the fixed cover 32 engages with engagement projection 448 provided inside hollow cylindrical portion 447 of the rotary power transmitting member 44, thus, the cartridge 30 advances straight with it rotation regulated. The cartridge 30 further advances straight in the arrowed direction until the engagement portion 331 of the cartridge opening/closing cover 33 comes in contact with projection portion 449 projected at the tip of the ring-shaped recessed portion 446 of the rotary power transmitting member 44.

Figure 10:
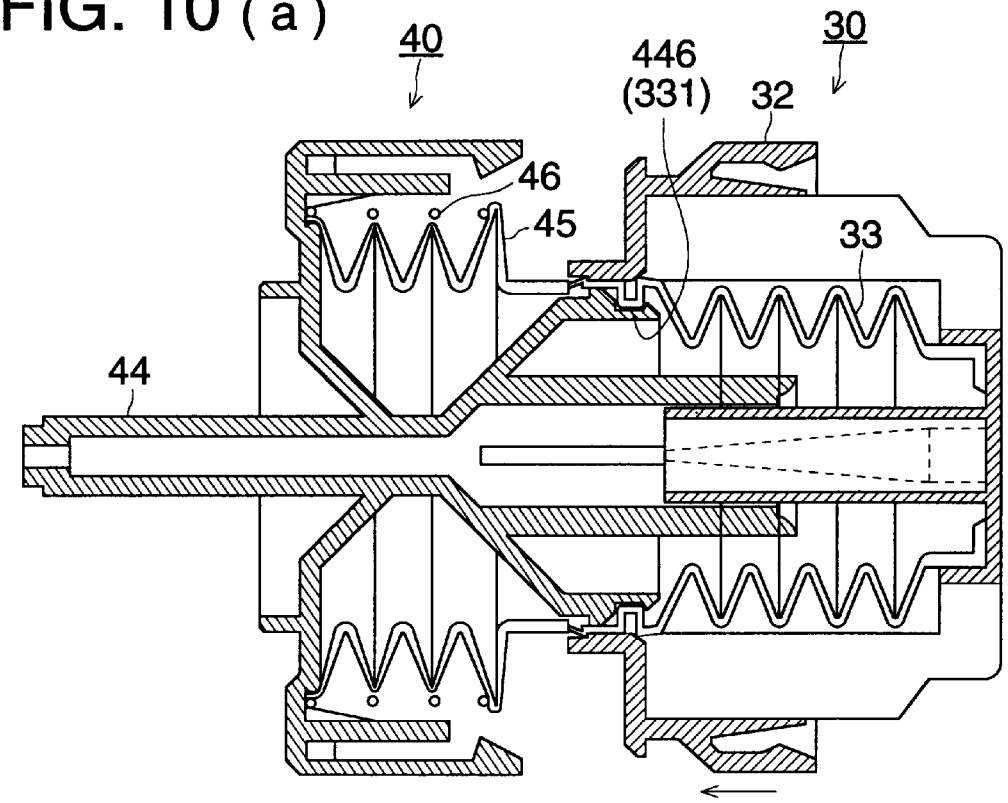
FIGS. 10(*a*) and 10(*b*) respectively represent a sectional view showing the intermediate process of the attachment of a cartridge on a developing agent replenishing apparatus.
Figure 10:
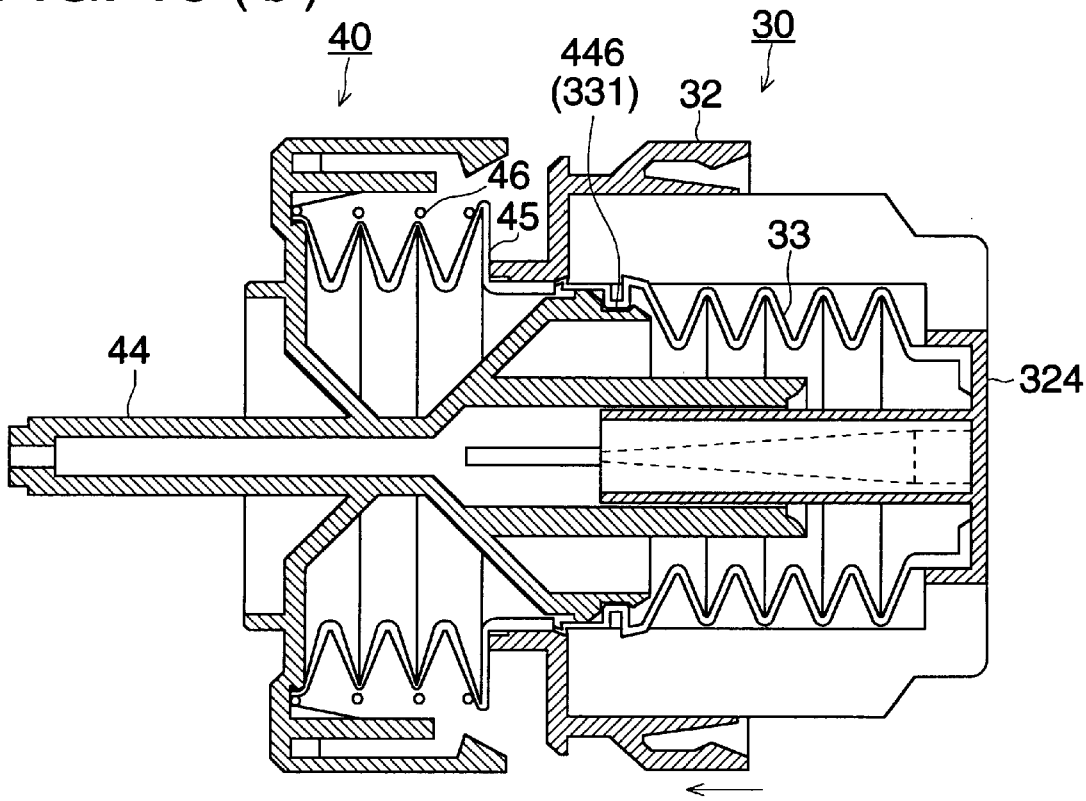

FIG. 10(*a*) represents the intermediate stage wherein the cartridge 30 is uninterruptedly advanced straight in the arrowed direction until it is attached on the developing agent replenishing apparatus 40. In this attaching stage, the engagement portion 331 of the cartridge opening/closing cover 33 engages with the ring-shaped recessed portion 446 of the rotary power transmitting member 44. In this case, a tip portion of bellow-shaped developing agent replenishing apparatus opening/closing cover 45 comes in contact with a tip portion of the cartridge opening/closing cover 33, and is slightly compressed against urging force of coil spring 46.

FIG. 10(*b*) represents the intermediate stage wherein the cartridge 30 is uninterruptedly advanced straight further in the arrowed direction until it is attached on the developing agent replenishing apparatus 40. In this attaching stage, the fixed cover 32 advances toward the rotary power transmitting member 44 in its fixed position, with the engagement portion 331 of the cartridge opening/closing cover 33 engaged with the ring-shaped recessed portion 446 of the rotary power transmitting member 44, and thereby the cartridge opening/closing cover 33 is compressed by bottom portion 324 of the advancing fixed cover 32. In this case, a tip portion of bellow-shaped developing agent replenishing apparatus opening/closing cover 45 comes in contact with a tip portion of the cartridge opening/closing cover 33 and a tip portion of the fixed cover 32, and is further compressed against urging force of coil spring 46.

FIG. 11 represents the stage wherein the cartridge 30 is uninterruptedly advanced straight further until it is completely attached on the developing agent replenishing apparatus 40. In this stage of completed attaching, engagement portion 328 of the fixed cover 32 engages with cartridge coming-off preventing portion 444 of the rotary power transmitting member 44 and is kept to be locked. Under this locked state, there is formed opening 321 between the cartridge opening/closing cover 33 and the rotary power transmitting member 44.

Under the state wherein the cartridge opening/closing cover 33 and the rotary power transmitting member 44 are connected and unified solidly, driving power from the driving source in an image forming apparatus is transmitted through an intermediate gear chain and the gear 47 mentioned above as shown in FIG. 6, and the rotary power transmitting member 44 engaging with the gear 47 rotates the fixed cover 32 that is unified solidly with the rotary power transmitting member. Further, container main body 31 engaging with the fixed cover 32 is also rotated simultaneously and solidly. Due to this rotation, developing agents contained in the container main body 31 are propelled toward opening portion 312 by spiral guide portion 311, then picked up by paddle 323, then dropped by gravity from paddle 323 rotated upward, then pass through replenishment opening 321 of the fixed cover 32, then pass through opening portion 441 being guided by developing agent guide portion 445, thus are forwarded to the developing agent receiving port 42. An amount of developing agents contained in the developing agent receiving port 42 is detected by an unillustrated photodetecting means, and when a replenishment amount of developing agents arrives at a prescribed value, the driving source stops its driving to stop replenishment of developing agents from the developing agent receiving port 42.

Figure 12:
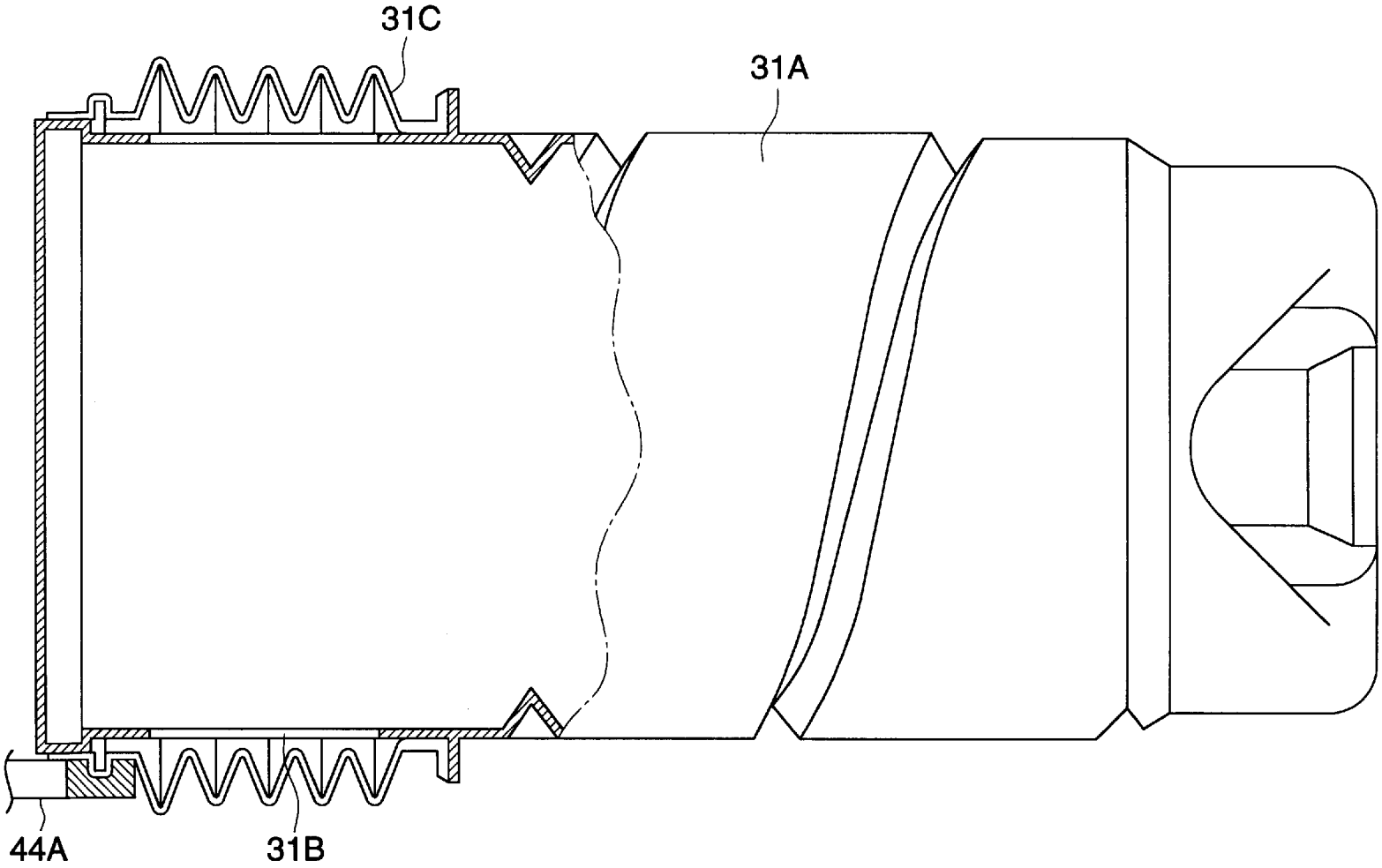
FIG. 12 is a sectional view showing another example of a cartridge of the invention. mission member.

FIG. 12 is a sectional view showing another example of a cartridge of the invention. This cartridge is one wherein container main body 31A thereof has, on its outer circumferential surface, a replenishment opening 31B, and bellow-shaped cartridge opening/closing cover 31C which makes it possible for the replenishment opening 31B to be opened and closed is provided outside the replenishment opening 31B. The cartridge opening/closing cover 31C is compressed by the rotary power transmitting member 44A and makes the opening 321 to be opened. The rotary power transmitting member 44A further drives the container main body 31A for rotation.

Figure 13:
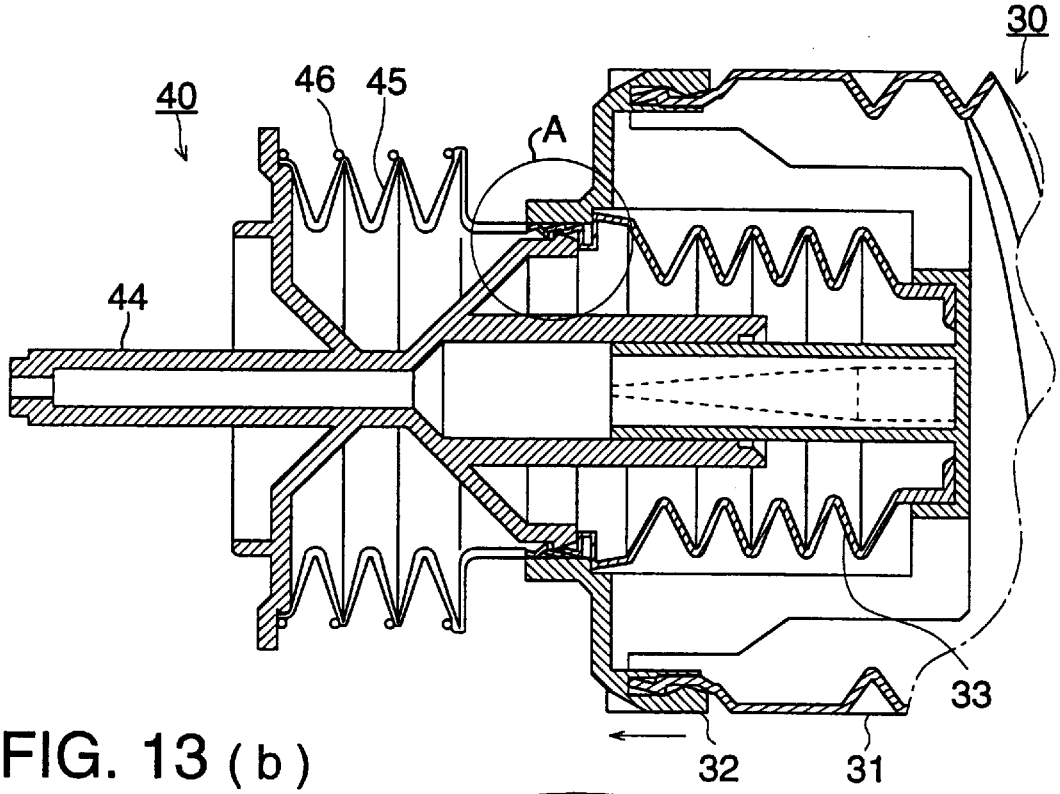
FIGS. 13(*a*) and 13(*b*) respectively represent a sectional view of primary parts of a cartridge whose replenishment opening of the fixed cover is about to be opened and of a developing agent replenishing apparatus, and an enlarged sectional view of part A.
Figure 13:
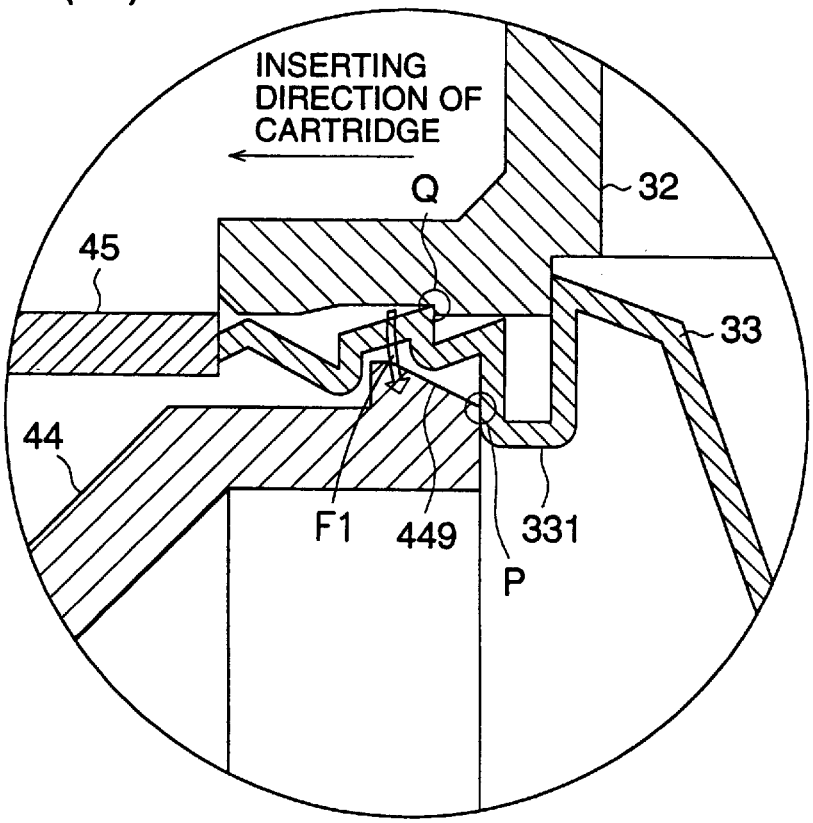
Figure 14:
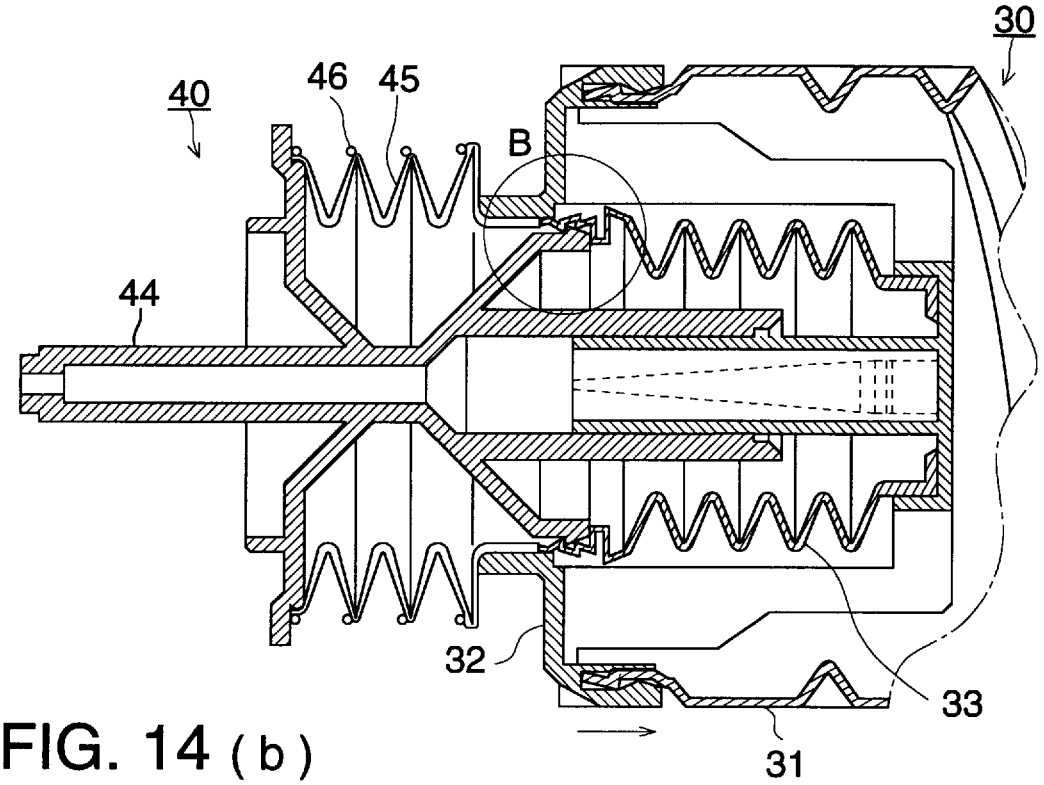
FIGS. 14(*a*) and 14(*b*) respectively represent a sectional view of primary parts of a cartridge whose replenishment opening of the fixed cover is being closed and of a developing agent replenishing apparatus, and an enlarged sectional view of part B.
Figure 14:
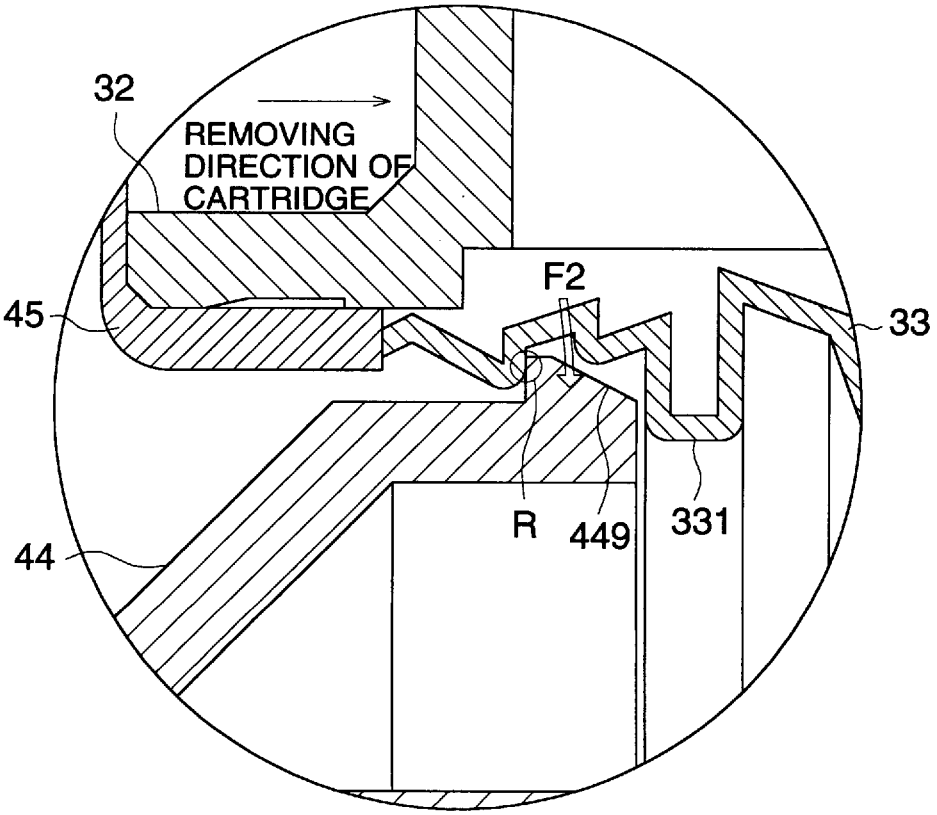

FIGS. 13(*a*) and 13(*b*) and FIGS. 14(*a*) and 14(*b*) respectively represent a sectional view showing an example of a developing agent replenishing apparatus. FIG. 13(*a*) is a sectional view of primary parts for cartridge 30 and developing agent replenishing apparatus 40 which are immediately before the opening 321 of the fixed cover 32 is opened. FIG. 13(*b*) is an enlarged sectional view of part A in FIG. 13(*a*). How the cartridge 30 is attached on the developing agent replenishing apparatus 40 will be omitted here because it has already been explained in FIG. 10(*a*).

A tip portion of the cartridge opening/closing cover 33 is bent as shown in the drawing. When projection portion 449 on the tip of the rotary power transmitting member 44 comes in contact with the front surface of the engagement portion 331 in the vicinity of the tip portion of the cartridge opening/closing cover 33 at the point P, a projection portion of the cartridge opening/closing cover 33 comes in contact with an inner wall at the tip portion of the fixed cover 32 at the point Q. As the cartridge opening/closing cover 33 further advances, moment F1 around point P is applied on point Q in the double-arrowed direction, and as the cartridge opening/closing cover 33 further advances, contact between the tip portion of the cartridge opening/closing cover 33 and the inner wall of the tip portion of the fixed cover 32 is released, and opening 321 of the fixed cover 32 is opened.

FIG. 14(*a*) is a sectional view of primary portions of cartridge 30 and developing agent replenishing apparatus 40, showing the moment when the opening 321 of the fixed cover 32 is closed.

When removing the cartridge 30 from the developing agent replenishing apparatus 40, the recessed portion of the cartridge opening/closing cover 33 comes in contact with the projection portion 449 mentioned above at point R. As the cartridge opening/closing cover 33 further moves to the right side in the drawing, moment F2 is applied to the point R on the cartridge opening/closing cover 33 in the double-arrowed direction, and when the cartridge opening/closing cover 33 further moves, engagement between the cartridge opening/closing cover 33 and the projection portion 449 is released, resulting in the state shown in FIG. 9(*b*). Incidentally, since projection 334 engages with a recessed portion of the fixed cover 32, the cartridge 30 is sealed hermetically. Accordingly, it does not happen that residual toner scatters in the machine, or soils operator's hands.

Figure 15:
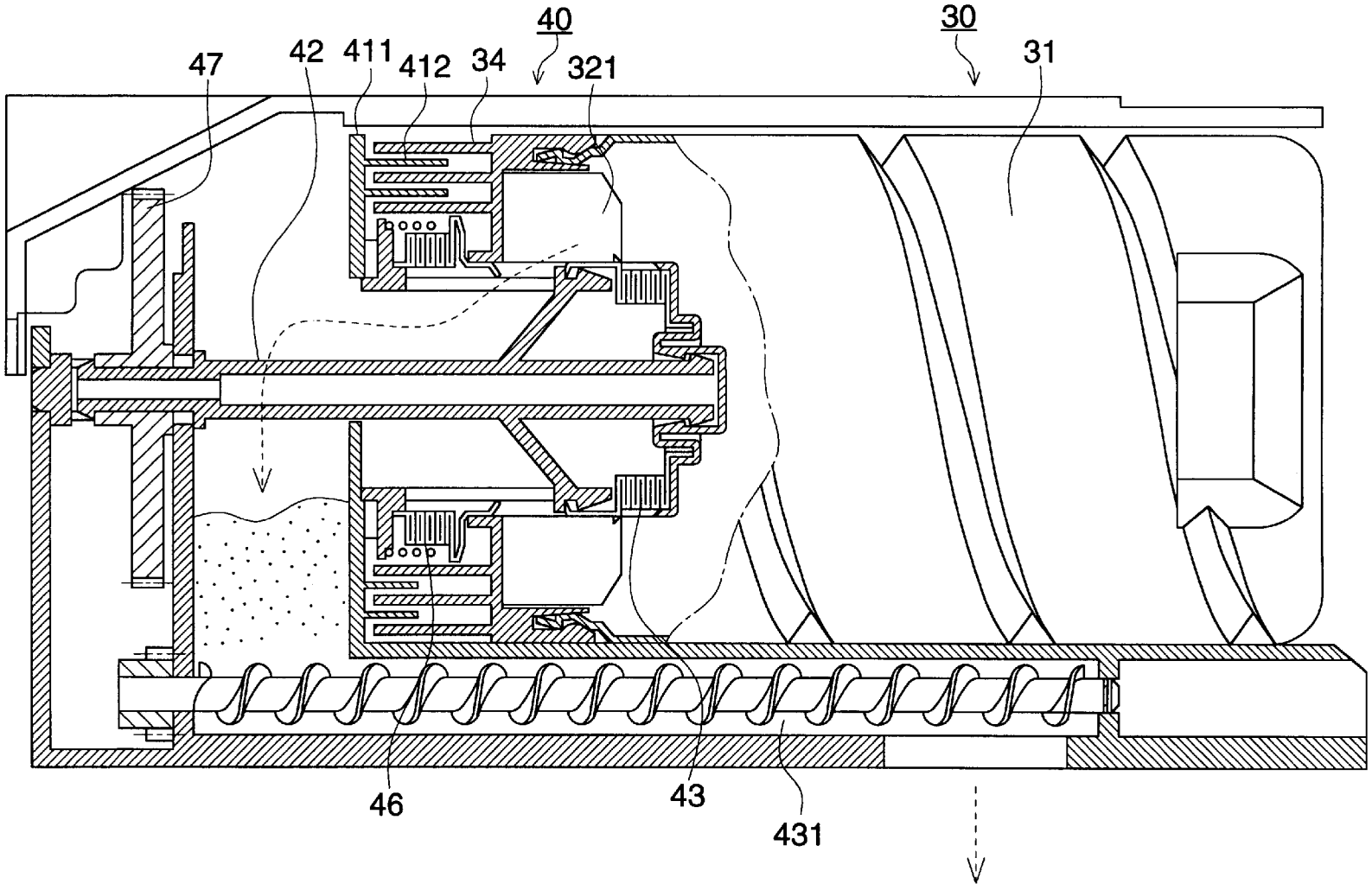
FIG. 15 is a sectional view of a cartridge of the invention equipped with a discriminator for preventing erroneous attachment and of a developing agent replenishing apparatus.

FIG. 15 is a sectional view showing examples of a cartridge equipped with a discriminator for preventing erroneous attaching and a developing agent replenishing apparatus of the invention, wherein FIG. 16(*a*) is a front view of cartridge 30 and FIG. 16(*b*) is a side view of the cartridge 30.

On the front side of the fixed cover 32, there is solidly fixed cartridge engagement portion 34 (first engagement portion, discriminator for preventing erroneous attaching). The cartridge engagement portion 34 is composed of a plurality of concentric-circle-shaped projections each having a different radius. On the other hand, on vertical surface portion 411 of cartridge attaching portion 41 on the developing agent replenishing apparatus 40, there are provided, in a shape of concentric circles, plural container-attaching-side engagement portions 412 (second engagement portion, discriminator receiver) so that they may be engaged with the cartridge engagement portion 34 corresponding thereto.

On a color image forming apparatus, there are provided a plurality of developing units 20 (Y, M, C and K) and a plurality of developing agent replenishing apparatuses 40 (Y, M, C and K) which correspond respectively to the developing units. On the developing agent replenishing apparatuses 40 (Y, M, C and K), there are attached, on a detachable basis, cartridges 30 (Y, M, C and K) corresponding respectively to the developing agent replenishing apparatuses (see FIG. 3). On each of the developing agent replenishing apparatuses 40 (Y, M, C and K), prescribed one corresponding to the developing agent replenishing apparatus out of the cartridges 30 (Y, M, C and K) needs to be attached correctly without being attached erroneously.

The cartridge engagement portion 34 (discriminator for preventing erroneous attaching) can discriminate the type of cartridge 30 when a radius of concentric-circle-shaped projection is changed. By providing the cartridge engagement portion 34 and the container-attaching-side engagement portions 412 (discriminator receiver), it is possible to prevent perfectly that cartridge 30 with different color toner is attached erroneously. Namely, when trying to attach wrong cartridge 30 on the developing agent replenishing apparatus 40 accidentally, the cartridge engagement portion 34 does not engage with the container-attaching-side engagement portion 412, making it impossible to attach, thus, replenishment opening 321 is not opened and developing agents are not leaked out accordingly.

(1) In the structure of the developing agent cartridge of the invention, if other end of a movable opening/closing cover is held when the opening/closing cover is closed, no problem is caused on sealing function of the opening/closing cover, because there is no portion that is rubbed by the opening/closing cover in the course of opening/closing operation. Further, easy operation can be attained because no great force is required for opening or closing the opening/closing cover. Further, if the opening/closing cover is opened or closed when a cartridge is attached or detached, attaching and detaching of the cartridge and opening and closing of the opening/closing cover can be carried out by a single action, which also contributes to easy operation.

(2) In the invention, when a portion where a cartridge attaching portion and an opening/closing cover come in contact with each other is established at a location where a cartridge projection can engage with an opening/closing cover projection or the engagement can be released, the cartridge attaching portion engages with the opening/closing cover at that location, and whereby engagement between the cartridge projection and the opening/closing cover projection, and releasing of the engagement can be carried out surely. As a result, the opening/closing cover can be opened and closed smoothly in the course of attaching and detaching of the cartridge, and problems mentioned above can be solved.

(3) Further, in the invention, since an opening/closing cover is flexible and expandable, it is greatly effective to establish the location where a cartridge attaching portion and the opening/closing cover come in contact with each other in a cartridge having therein such opening/closing cover.

(4) Further, in the invention wherein the first engagement portion is provided on the end face of a cartridge and the second engagement portion is provided on the cartridge-discriminating portion which does not rotate together with the cartridge attached on the apparatus and is fixed on the apparatus, and the cartridge can be attached on the apparatus only when the first engagement portion agrees with the second engagement portion. Therefore, it is possible to simply prevent erroneous attaching of the cartridge. In addition, by providing the second engagement portion on the cartridge-discriminating portion which does not rotate together with the cartridge and is fixed on the apparatus, it is further possible to make the structure of the rotary power transmitting portion for both the means to rotate the attached cartridge and the cartridge to be simple, and the foregoing does not hinder the rotation of the cartridge. It is possible to prevent erroneous attaching of the cartridge without hindering the rotation of the cartridge, by making the first engagement portion and second engagement portion to be ring-shaped.

Figure 17:
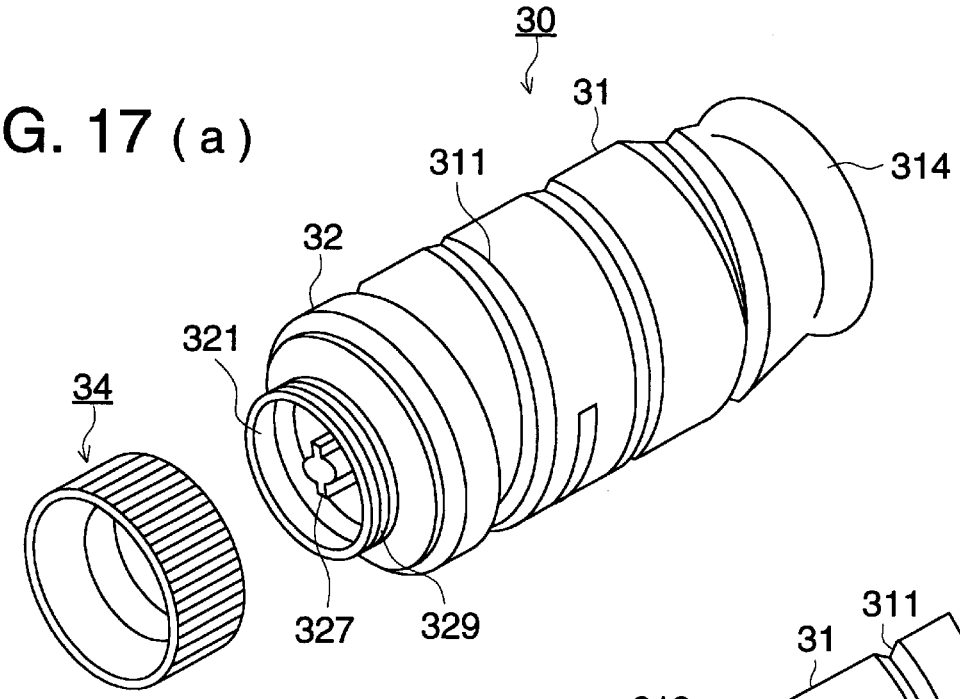
FIGS. 17(*a*)/and 17(*b*) respectively represent a general perspective view of a developing agent cartridge and a partial perspective view thereof.
Figure 17:
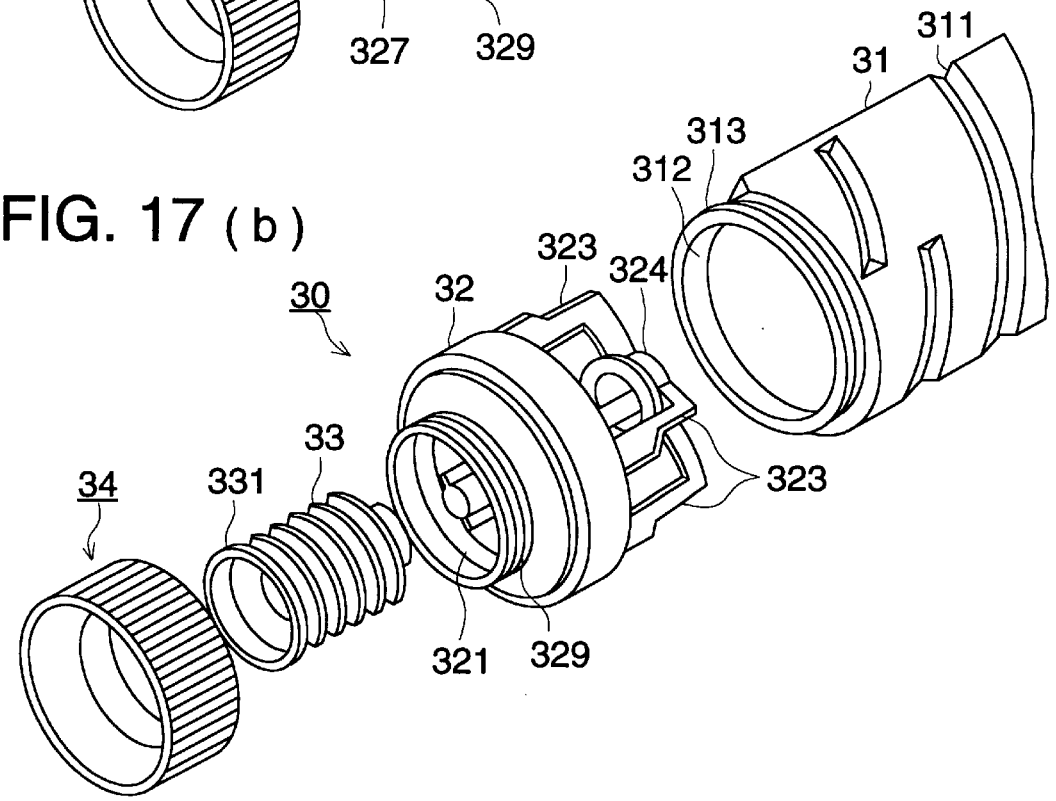
Figure 18:
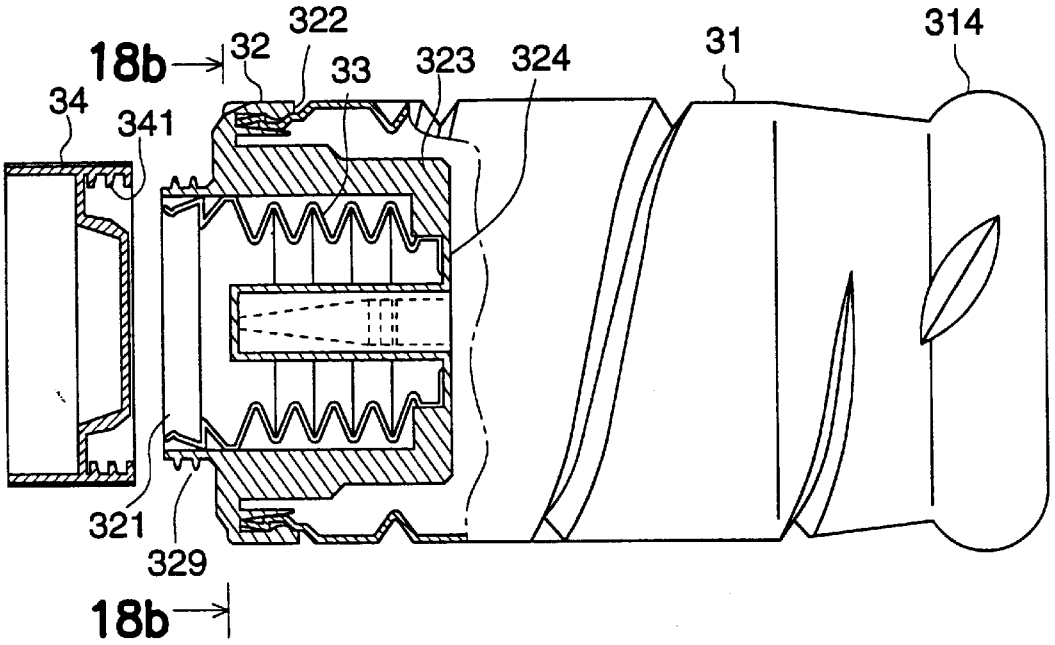
FIGS. 18(*a*)–18(*c*) respectively represent a top view with a partial section of a developing agent cartridge, a sectional side view taken on line 18*b*—18*b* thereof, and an exploded top view thereof taken on line 18*c*—18*c*.
Figure 18:
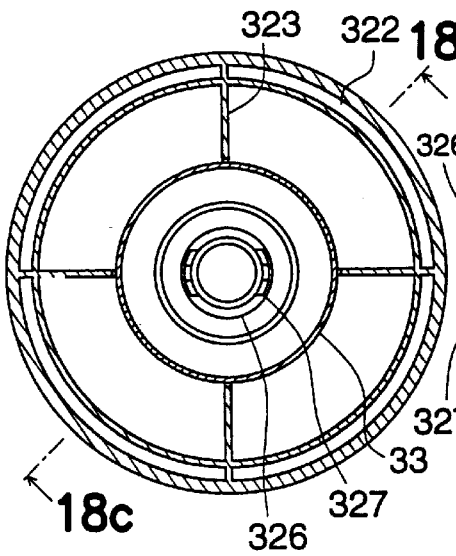
Figure 18:
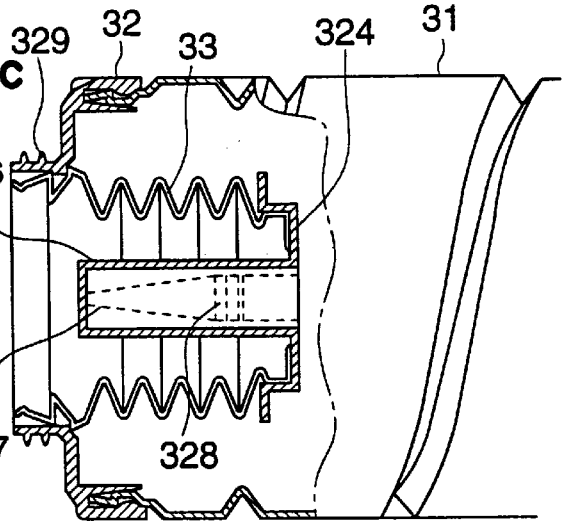
Figure 19:
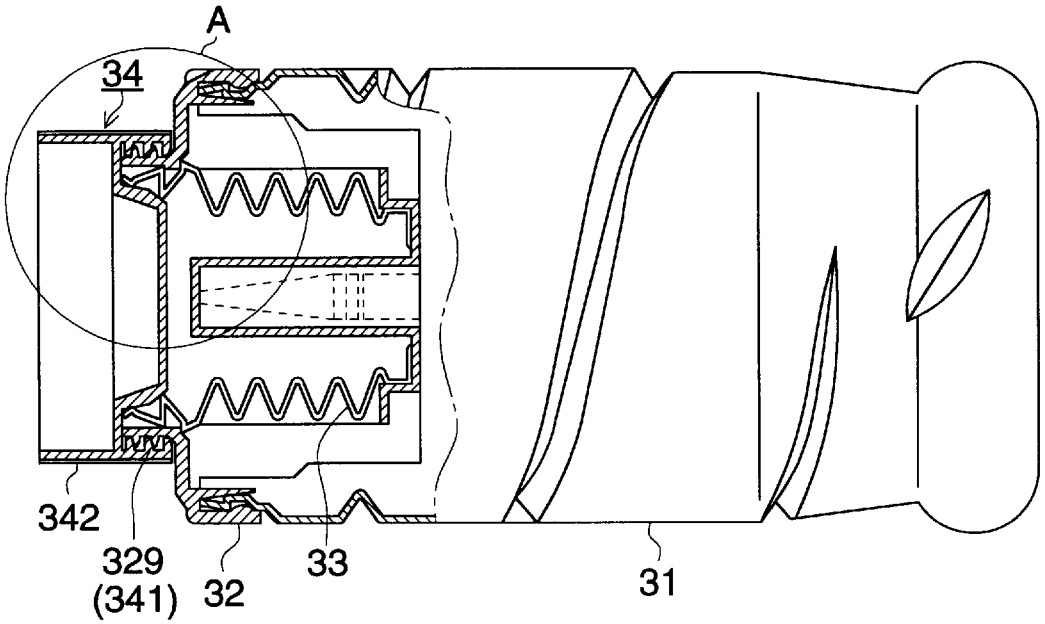
FIGS. 19(*a*) and 19(*b*) respectively represent a top view with a partial section of a developing agent cartridge, and an enlarged sectional view of part A.
Figure 19:
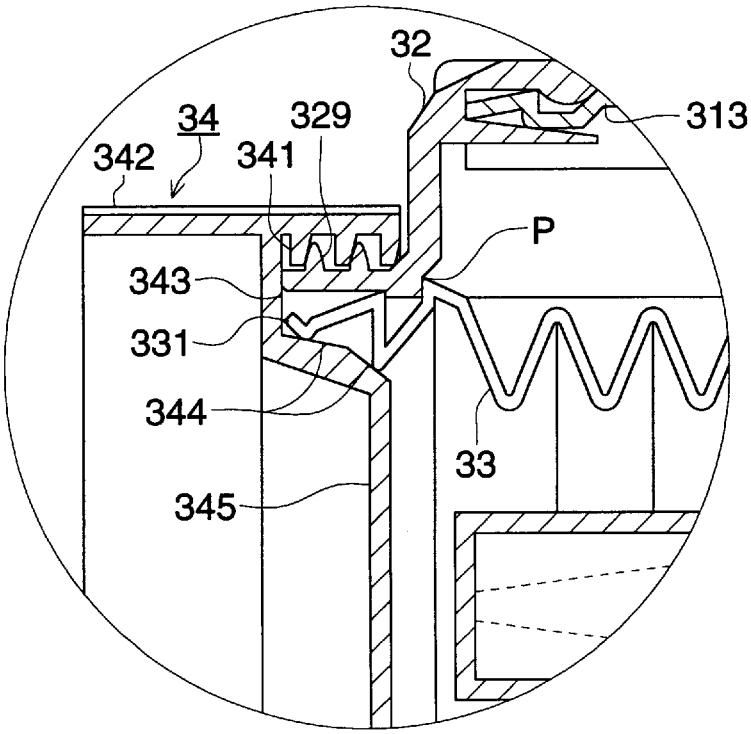

Each of FIGS. 17(*a*) and 17(*b*), FIGS. 18(*a*)–18(*c*) and FIGS. 19(*a*) and 19(*b*) represents cartridge 30 and cap member 34, wherein FIG. 17(*a*) is a general perspective view, FIG. 17(*b*) is a partial perspective view, FIG. 18(*a*) is a partial and sectional top view, FIG. 18(*b*) is a sectional side view taken on line 18*b*—18*b*, FIG. 18(*c*) is an exploded top view taken on line 18*c*—18*c*, FIG. 19(*a*) is a partial and sectional top view, and FIG. 19(*b*) is an enlarged section of part A.

Cartridge 30 which is in a shape of a cylinder having on its inner circumferential surface guide portion (developing agent guiding portion) 311 composed of spiral projected stripes, is composed of cartridge main body 31 containing therein developing agents, cartridge fixed cover (hereinafter referred to as a fixed cover) 32 having outlet 321 fixed solidly on opening portion 312 of the cartridge main body 31, and cartridge opening/closing cover (hereinafter referred to as an opening/closing cover) 33 which engages with the fixed cover 32 and is in a shape of expandable bellows.

One end of the opening/closing cover 33 is fixed (welded) on bottom portion 324 in the inner part of the fixed cover 32 through ultrasonic welding. This fixation can also be done by adhesives.

On the other hand, in the other end of the opening/closing cover 33, the recessed portion provided on the inner circumferential surface of the fixed cover 32 is engaged with a projected portion of the opening/closing cover (point P) as shown in FIG. 19(*b*), so that developing agents are not ejected out of cartridge 30.

When cartridge 30 is attached on developing agent replenishing apparatus 40, the rotary power transmitting member 44 mentioned above pushes the opening/closing cover 33, then engagement at point P is released and contraction is made, and developing agents are ejected to developing agent receiving port 42 from the cartridge 30.

When opening/closing cover 33 with such structure as stated above is employed, if only engagement force between the recessed portion provided on the inner circumferential surface of the fixed cover 32 and the projected portion of the opening/closing cover is secured, developing agents do not overflow the cartridge 30, and sealing function of the opening/closing cover 33 can be secured.

Engagement claw portion 313 provided on the surrounding of opening portion 312 of the cartridge main body 31 is closely engaged with recessed portion 322 provided on the inner circumferential surface of the fixed cover 32 to be unified. The numeral 314 is a grip portion for making it easy to attach and detach the cartridge 30 when attaching the cartridge 30 on the cartridge attaching portion 41, and it is provided on the other end portion facing one end where outlet 321 is provided. The grip portion 314 is formed to be easily gripped with finger tips and to easily draw out the cartridge 30.

On the outer circumferential surface at a tip portion on the outlet 321 side of the aforesaid fixed cover 32, there is spirally formed male screw portion 329. The male screw portion 329 engages with female screw portion 341 of the cap member 34. The outermost portion of the cap member 34 is formed to be serrated cylindrical grip portion 342. In the inside of the cap member 34, there is formed a wall surface, and when the cap member 34 is engaged with the fixed cover 32, the wall surface seals the outlet 321 of the fixed cover 32. Namely, in the wall surface mentioned above, partition wall 343 connected to the end of the female portion 341 touches the forefront portion of the male portion 329 of the fixed cover 32 when the grip portion 342 of the cap member 34 is gripped and screwed to be engaged with the fixed cover 32, so that the cap member 34 may be screwed in the fixed cover 32 tightly. Slanted surface portion (urging portion) 344 connected to the partition wall portion 343 is in pressure contact with engagement portion 331 which is bent at the forefront portion of the bellow-shaped opening/closing cover 33 to press the engagement portion 331 in the direction of the inner circumferential surface (downward direction in the drawing) in the tip cylindrical portion of the fixed cover 32 having the male screw portion 329. In such a way, force of engagement between the recessed portion provided on the inner circumferential surface of the fixed cover 32 and the projected portion on the opening/closing cover is increased. The numeral 345 is a partition wall portion to be connected to the slanted surface portion 344.

Therefore, the outlet 321 of the fixed cover 32 is sealed by the partition wall portions 343 and 345 and by the slanted surface portion 344, and when the slanted surface portion 344 presses the forefront engagement portion 331 of the opening/closing cover 33 and urges the opening/closing cover 33 in the closing direction, in particular, developing agents contained in the cartridge main body 31 can be prevented from leaking out. Concurrently with this, the engagement portion 331 which is bent at the forefront portion of the opening/closing cover 33 is squeezed and deformed elastically to prevent slackening of engagement between the male screw portion 329 and the female screw portion 341, and thereby to keep the cap member 34 to be bound to the fixed cover 32 tightly.

If the cap member 34 of this type is installed on the outlet 321 side, it does not happen that the opening/closing cover 33 is opened during transportation of the cartridge 30, and occurrence of leakage of developing agents caused during transportation thereof can be prevented.

In the present invention, it is possible to secure the sealing function of an opening/closing cover, and it is also possible to prevent that the opening/closing cover is opened and developing agents overflow during transportation of the developing agents.

It is further possible to open and close the opening/closing cover simply and correctly.

What is claimed is:

1. A developing agent replenishing apparatus comprising:

(a) a developing agent receiving port for receiving a developing agent from a cartridge storing the developing agent therein when the cartridge is mounted to the developing agent receiving port; and (b) a conveyor for conveying the developing agent received in the developing agent receiving port to a developing device, wherein the developing agent receiving port comprises a receiving opening and a first cylindrical expandable cover for opening and closing said receiving opening.

2. The apparatus of claim 1, wherein the first cover comprises a bellows cover.

3. The apparatus of claim 1, wherein the first cover is provided on a main body of the apparatus so that a periphery of a first end of the first cover is fixed on the main body and a periphery of a second end of the first cover is movable with respect to the main body.

4. The apparatus of claim 3, wherein when the receiving opening is closed by the first cover, the periphery of the second end of the first cover is movably engaged with the main body of the apparatus.

5. The apparatus of claim 1, wherein the first cover is expandable and compressible in a direction substantially perpendicular to an end surface of the first cover.

6. The apparatus of claim 1, wherein when the cartridge is mounted to the apparatus, the first cover is compressed to open said receiving opening by engagement with an engaging element of the cartridge.

7. The apparatus of claim 6, wherein the cartridge is dismounted, the first cover is expanded to close said receiving opening by releasing the engagement with the engaging element of the cartridge.

8. The apparatus of claim 1, further comprising an urging member provided in a vicinity of the first cover for urging the first cover in an expanding direction thereof.

9. The apparatus of claim 1, wherein said cartridge comprises:

a replenishment opening through which the developing agent stored in the cartridge is replenished to said developing agent receiving port; and a second cylindrical expandable cover provided on the replenishment opening for opening and closing the replenishment opening.

10. The apparatus of claim 9, wherein the second cover comprises a bellows cover.

11. The apparatus of claim 9, wherein the second cover is provided on a main body of the cartridge so that a periphery of a first end of the second cover is fixed on the main body of the cartridge and a periphery of a second end of the second cover is movable with respect to the main body of the cartridge, and wherein the first cover is provided on the main body of the apparatus so that a periphery of a first end of the first cover is fixed on the main body of the apparatus and a periphery of a second end of the first cover is movable with respect to the main body of the apparatus.

12. The apparatus of claim 11, wherein the periphery of said first end of the second cover is fixed by welding on the main body of the cartridge, and the periphery of said first end of the first cover is fixed by welding on the main body of the apparatus.

13. The apparatus of claim 11, wherein when the replenishment opening of the cartridge is closed by the second cover, the periphery of said second end of the second cover is movably engaged with the main body of the cartridge, and when the receiving opening of the apparatus is closed by the first cover, the periphery of said second end of the first cover is movably engaged with the main body of the apparatus.

14. The apparatus of claim 9, wherein when the cartridge is mounted to the apparatus, the second cover is compressed to open said replenishment opening by engagement with an engaging element of the apparatus.

15. The apparatus of claim 14, wherein when the cartridge is dismounted from the apparatus, the second cover is expanded to close said replenishment opening by releasing the engagement with the engaging element of the apparatus.

16. The apparatus of claim 9, wherein when the cartridge is mounted to the apparatus, the first cover is compressed to open said receiving opening by an engagement with an engaging element of the cartridge.

17. The apparatus of claim 16, wherein when the cartridge is dismounted from the apparatus, the first cover is expanded to close said receiving opening by releasing the engagement with the engaging element of the cartridge.

18. The apparatus of claim 9 further comprising an urging member is provided in a vicinity of the first cover for urging the first cover in an expanding direction thereof.

19. The apparatus of claim 9, wherein a compressing and expanding direction of the second cover is substantially parallel to a compressing and expanding direction of the first cover.

20. The apparatus of claim 9, wherein a direction of a rotary axis of the cartridge is substantially parallel to a compressing and expanding direction of the first and second covers.

21. The apparatus of claim 1, wherein the cartridge has a substantially cylindrical shape, and a replenishment opening of the cartridge is provided at an end portion of the cartridge.

22. The apparatus of claim 1, wherein a replenishment opening of the cartridge is provided at an inner surface opposite to an outer surface of the cartridge.

23. The apparatus of claim 1, wherein the first and second covers are compressed and expanded in a direction substantially perpendicular to an end surface of each of the first and second covers.

24. The apparatus of claim 9, wherein the replenishment opening of the cartridge is closed by engagement of a cartridge protrusion provided on a main body of the cartridge with a cover protrusion provided on the second cover, and when the cartridge is mounted to and dismounted from the apparatus, the second cover is compressed and expanded, respectively, by bringing a mounting portion of the cartridge provided on the apparatus into contact with the second cover, and wherein a contact portion of said mounting portion of the cartridge with the second cover comprises a portion with which the cartridge protrusion can be engaged and disengaged from the cover protrusion.

25. The apparatus of claim 1, further comprising a rotating means for rotating the cartridge, and wherein when the cartridge is rotated the developing agent is supplied to the developing agent receiving port via a spiral groove formed on an inner surface of the cartridge.

26. The apparatus of claim 25, wherein said receiving opening is provided substantially on a rotation axis of the cartridge.

27. The apparatus of claim 25, wherein the first cover is compressed and expanded in a direction of a rotation axis of the cartridge.

28. A developing agent storing cartridge comprising:

(a) a replenishment opening through which a developer agent stored in the cartridge is replenished; and (b) a cylindrical expandable cover provided on the replenishment opening for opening and closing the replenishment opening.

29. The cartridge of claim 28, wherein the cover comprises a bellows cover.

30. The cartridge of claim 28, wherein the cover is provided on a main body of the cartridge so that a periphery of a first end of the cover is fixed on the main body and a periphery of a second end of the cover is movable with respect to the main body.

31. The cartridge of claim 30, wherein the periphery of said first end of the cover is fixed by welding on the main body of the cartridge.

32. The cartridge of claim 30, wherein when the replenishment opening is closed by the cover, the periphery of said second end of the cover is movably engaged with the main body of the cartridge.

33. The cartridge of claim 28, wherein the cartridge has a substantially cylindrical shape, and the replenishment opening of the cartridge is provided at an end portion of the cartridge.

34. The cartridge of claim 28, wherein the replenishment opening of the cartridge is provided at an inner surface opposite to an outer surface of the cartridge.

35. The cartridge of claim 28, wherein the cover is compressed or expanded in a direction substantially perpendicular to an end surface of the cover.

36. The cartridge of claim 28, wherein when the cartridge is mounted to a developing agent replenishing apparatus, the cover is compressed to open said replenishment opening by an engagement with an engaging element of the apparatus.

37. The cartridge of claim 36, wherein when the cartridge is dismounted from the apparatus, the cover is expanded to close said replenishment opening by releasing the engagement with the engaging element of the apparatus.

38. The cartridge of claim 28, wherein a spiral groove is formed on an inner side of the cartridge.

39. The cartridge of claim 28, further comprising a cap member detachably provided on the cover for urging the cover toward a main body of the cartridge.

* * * * *